US008814303B2

(12) United States Patent
Mano

(10) Patent No.: US 8,814,303 B2
(45) Date of Patent: Aug. 26, 2014

(54) PRINTING DEVICE FOR CONTROLLING PRINTING SPEED

(75) Inventor: Takahiro Mano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 195 days.

(21) Appl. No.: 13/173,477

(22) Filed: Jun. 30, 2011

(65) Prior Publication Data

US 2012/0001974 A1 Jan. 5, 2012

(30) Foreign Application Priority Data

Jun. 30, 2010 (JP) ..... 2010-148755

(51) Int. Cl.
*B41J 29/38* (2006.01)
*B41J 2/125* (2006.01)
*B41J 2/165* (2006.01)

(52) U.S. Cl.
CPC *B41J 29/38* (2013.01); *B41J 2/125* (2013.01); *B41J 2/16508* (2013.01)
USPC ..... 347/14

(58) Field of Classification Search
None
See application file for complete search history.

(56) References Cited

U.S. PATENT DOCUMENTS

| | | | | | |
|---|---|---|---|---|---|
| 5,745,255 | A | * | 4/1998 | Yamaguchi | 358/1.15 |
| 5,913,018 | A | * | 6/1999 | Sela | 358/1.17 |
| 6,100,998 | A | * | 8/2000 | Nagao et al. | 358/1.9 |
| 2009/0033991 | A1 | | 2/2009 | Murashima | |

FOREIGN PATENT DOCUMENTS

| | | | | | |
|---|---|---|---|---|---|
| JP | 06344639 | A | * | 12/1994 | B41J 29/38 |
| JP | 10-138465 | A | | 5/1998 | |
| JP | 2000-015835 | A | | 1/2000 | |
| JP | 2002-248751 | A | | 9/2002 | |
| JP | 2002248751 | A | * | 9/2002 | B41J 2/01 |
| JP | 2004-050432 | A | | 2/2004 | |
| JP | 2004-136468 | A | | 5/2004 | |
| JP | 2009-037298 | A | | 2/2009 | |

* cited by examiner

*Primary Examiner* — Geoffrey Mruk
*Assistant Examiner* — Bradley Thies
(74) *Attorney, Agent, or Firm* — Global IP Counselors, LLP

(57) ABSTRACT

A printing device characterized by comprising a speed-acquiring section that acquires a creation speed when operational data is to be created by data conversion section on the basis of print data, wherein in a case where the creation speed acquired by the speed-acquiring section is lower than a prescribed speed, the speed at which printing section deposits printing matter onto a printing medium is made lower than in a case where the creation speed is higher than the prescribed speed.

8 Claims, 10 Drawing Sheets

PRINTING DEVICE FOR CONTROLLING PRINTING SPEED

CROSS-REFERENCE TO RELATED APPLICATIONS

This application claims priority to Japanese Patent Application No. 2010-148755 filed on Jun. 30, 2010. The entire disclosure of Japanese Patent Application No. 2010-148755 is hereby incorporated herein by reference.

BACKGROUND

1. Technological Field

The invention relates to a printing device and a printing method for carrying out a printing process on a printing medium using printing matter such as ink.

2. Background Technology

An example of a printing device of this type in the art is the printing device proposed in Patent Citation 1, for example. The printing device disclosed in Patent Citation 1 has a carriage (traveling body) which travels in reciprocating fashion along a main scanning direction, a print head supported on the carriage and having a plurality of nozzles, and a control device for controlling the printing device in its entirety. This control device saves print data that is received wirelessly from an external device, and carries out a printing process based on the print data saved to the buffer.

In cases where print data is received wirelessly, owing to factors such as varying distance between the printing device and the external device or the presence of obstacles, the communication speed between the printing device and the external device may vary. If the communication speed varies, the accumulated amount of print data that is saved to the buffer per unit time fluctuates. Particularly when communication speed is slow, there is a risk of the carriage assuming the idle state until print data equivalent to a single scan is received by the carriage, and data processing inside the control device has completed.

In the printing device disclosed in Patent Citation 1, the control device sends the external device an instruction prompting modification of the data length of the print data equivalent to a single scan of the carriage, depending on the communication speed. As a result, in cases where the communication speed is high, first print data having a first data length is sent from the external device. Then, in the printing device, on the basis of the first print data, a first printing process is carried out using all of the nozzles of the print head. On the other hand, in cases where the communication speed is low, second print data having a second data length shorter than the first data length is sent from the external device. Then, in the printing device, on the basis of the second print data, a second printing process is carried out using some of the nozzles of the print head. Specifically, depending on the communication speed, adjustments are made to the spacing in the sub-scanning direction of regions in which ink is deposited onto the printing medium though a single iteration of travel of the carriage. Because of this, situations where, during the printing process, the carriage goes into the idle state to await print data, and quality is diminished due to drying out of the ink during printing, are suppressed.

Japanese Patent Application Publication No. 2002-248751 (Patent Citation 1) is an example of the related art.

SUMMARY

Problems to be Solved by the Invention

In the control device, conversion processes such as an expansion process and generation process are carried out on the received print data, whereupon spraying of ink by the print head and travel of the carriage are controlled on the basis of the print data having undergone the conversion processes. The time required for these conversion processes fluctuates depending on the print data compression format and description format. However, in the printing device of Patent Citation 1, whereas the number of nozzles that may be used is set in consideration of communication speed with the external device, no consideration whatsoever is given to the time needed for processing of print data inside the control device. Because of this, there is a need for improvement in the accuracy of setting spacing in the sub-scanning direction of regions of the printing medium that are printed by single iteration of travel of the carriage. This issue is not limited to cases of wireless communications, and even with wired communications, a similar issue is encountered in cases where communication speed fluctuates during communication.

With the foregoing in view, it is an object of the invention to provide a printing device and a printing method for appropriately setting the size of regions in which printing matter is deposited on a printing medium by driving of a printing section a single time.

Means Used to Solve the Above-Mentioned Problems

In order to achieve the stated object, the printing device of the invention provides a printing device including a printing section having a print head for depositing printing matter onto a printing medium; a conveying section for causing the printing medium to travel in a prescribed conveyance direction in a relative manner, using the print head as a reference; a data conversion section for converting acquired print data and creating operating data; and a printing control section for controlling the printing section and the conveying section on the basis of the operating data created by the data conversion section, and for causing printing matter to be deposited onto the printing medium and the printing medium to travel in a relative manner using the print head as a reference; wherein the device is characterized in further including a speed-acquiring section for acquiring a creation speed when the operational data is to be created by the data conversion section; and in a case where the creation speed acquired by the speed-acquiring section is lower than a prescribed speed, the printing control section reduces the speed at which the printing section deposits printing matter onto the printing medium, to a speed lower than in the case where the creation speed is higher than the prescribed speed.

According to the aforedescribed aspect, in the case where the creation speed when operational data is to be created from print data acquired by the printing device is low, the speed at which the printing section deposits printing matter onto the printing medium decreases to a value lower than in the case when the creation speed is higher. Specifically, because the speed of the aforementioned deposition is set in accordance with the data creation speed within the printing device, the speed of the aforementioned deposition can be set more accurately than when the speed of the aforementioned deposition is set without consideration of the data creation speed.

In the printing device of the invention, the printing section further has a traveling body for supporting the print head, the traveling body adapted to travel in reciprocating fashion in a scanning direction that intersects the conveyance direction; and in the case where the creation speed acquired by the speed-acquiring section is lower than the prescribed speed, the printing control section performs an operation so that the number of iterations of travel made by the traveling body in the printing process associated with print data is greater than in the case where the creation speed is higher than the prescribed speed.

According to the aforedescribed aspect, in cases where the data creation speed is low, the number of iterations of travel by the traveling body in the printing process is higher than the creation speed is high, and the speed of the aforementioned deposition decreases. In this case, the idling time of the printing section during the printing process can be made shorter than in the case where the printing section is idled until completion of generation of operational data having fixed data length irrespective of the data creation speed.

In the printing device of the invention, the print head has a plurality of nozzles for spraying printing matter, each of the nozzles being disposed in the conveyance direction; and in the case where the creation speed acquired by the speed-acquiring section is lower than the prescribed speed, the printing control section performs an operation so that, among the nozzles, the number of candidate nozzles available for use in the printing process is smaller than in the case where the creation speed is higher than the prescribed speed. In the case of a plurality of candidate nozzles, it is preferable for no nozzles other than candidate nozzles to be present between candidate nozzles that neighbor one another in the conveyance direction. Respective disposition of nozzles in the conveyance direction is not limited to disposition parallel to the conveyance direction, and a disposition that intersects the conveyance direction is acceptable provided it is not orthogonal to the conveyance direction.

According to the aforedescribed aspect, in cases where the data creation speed is low, the number of candidate nozzles selectable for use in the printing process is lower than in the case of a high creation speed. Because of this, the printing process using the candidate nozzles can be carried out rapidly on the basis of operational data of short data length. Consequently, the idling time of the printing section during the printing process can be made shorter than in the case where the printing section is idled until completion of generation of operational data having fixed data length irrespective of the data creation speed.

The printing device of the invention further including a data-acquiring section for acquiring compressed print data; wherein the data conversion section carries out an expansion process on print data acquired by the data-acquiring section, the expansion process being carried out in accordance with the compression format of the data, and carries out processing of the expanded print data in accordance with the description format of the data, thereby creating operational data; and the speed-acquiring section acquires creation speed on the basis of at least one of the compression format and the description format of the print data acquired by the data-acquiring section. Optionally, creation speed is acquired on the basis of the speed at which the data-acquiring section acquires the print data as well.

According to the aforedescribed aspect, the speed of the aforementioned deposition is set on the basis of at least one of the compression format and the description format of the print data, and in addition thereto, on the speed of acquisition of the print data. The compression format and/or description format and the speed of acquisition of the print data can be decided immediately after starting creation of data by the data conversion section. Consequently, creation speed can be acquired before starting to deposit printing matter onto the printing medium.

In the printing device of the invention, in a case that the creation speed acquired by the speed-acquiring section has increased during printing, the printing control section maintains the speed at which the printing section deposits printing matter onto the printing medium, in the state before the creation speed increases.

According to the aforedescribed aspect, the speed of the aforementioned deposition can be maintained even if the data creation speed has increased in the course of printing.

The printing device of the invention further comprises a printing-matter-receiving section for receiving printing matter sprayed from the print head, and a maintenance control section for controlling the printing section in order to spray the printing matter into the printing-matter-receiving section from the print head, for the purpose of maintaining accuracy of printing onto the printing medium; wherein in the course of printing onto the printing medium, the maintenance control section disposes the printing-matter-receiving section in opposition to the print head and causes the printing matter to be sprayed into the printing-matter-receiving section from the candidate nozzles, while meanwhile controlling the printing section so as to restrict spray of the printing matter into the printing-matter-receiving section from nozzles other than the candidate nozzles.

According to the aforedescribed aspect, the process for maintaining accuracy of printing onto the printing medium (herein also referred to as "maintenance") is not carried out on nozzles other than the candidate nozzles. Because of this, the amount of printing matter consumed in association with the maintenance can be reduced relative to the case where maintenance is carried out on the other nozzles as well.

In the printing device of the invention, in a case where the creation speed is lower than a prescribed speed, the printing control section reduces the width in the conveyance direction of a region where printing matter is deposited onto the printing medium by a single driving of the printing section to a width smaller than in the case where the creation speed is higher than the prescribed speed, and thereby reduces the speed at which the printing section deposits the printing matter onto the printing medium.

According to the aforedescribed aspect, by constricting the width, the speed at which the printing section deposits the printing matter onto the printing medium can be reduced, even while the speed at which the printing matter is deposited for a given width is substantially constant.

The printing method for printing using printing matter onto a printing medium conveyed in a prescribed conveyance direction through driving of the printing section on the basis of acquired print data, the method characterized in comprising: a speed-acquiring step for acquiring a creation speed when print data is converted and operational data is created; and a printing step for performing a printing process in such a manner that, in a case where the creation speed acquired in the speed-acquiring step is lower than a prescribed speed, the spacing in the conveyance direction of a region where printing matter is deposited onto the printing medium by a single driving of the printing section is smaller than in the case where the creation speed is higher than the prescribed speed.

According to the aforedescribed aspect, there are afforded operational and working effects analogous to those of the printing device described previously.

DETAILED DESCRIPTION OF EXEMPLARY EMBODIMENTS

First Embodiment

A first embodiment which embodies the invention is described below based on FIGS. 1 to 10.

Figure 1A:
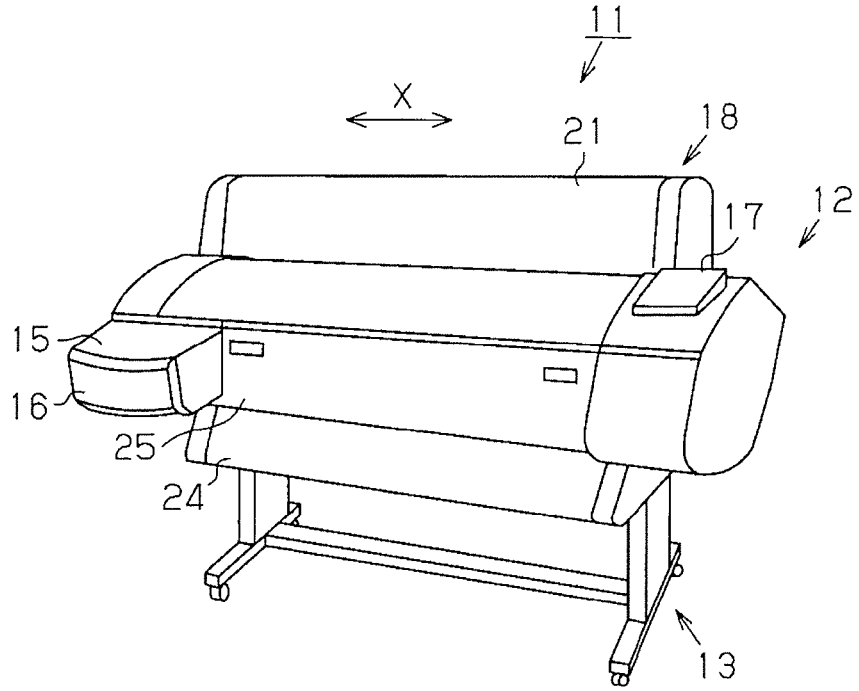
FIGS. 1A and 1B are generalized perspective views of a printing device of a first embodiment.
Figure 1B:
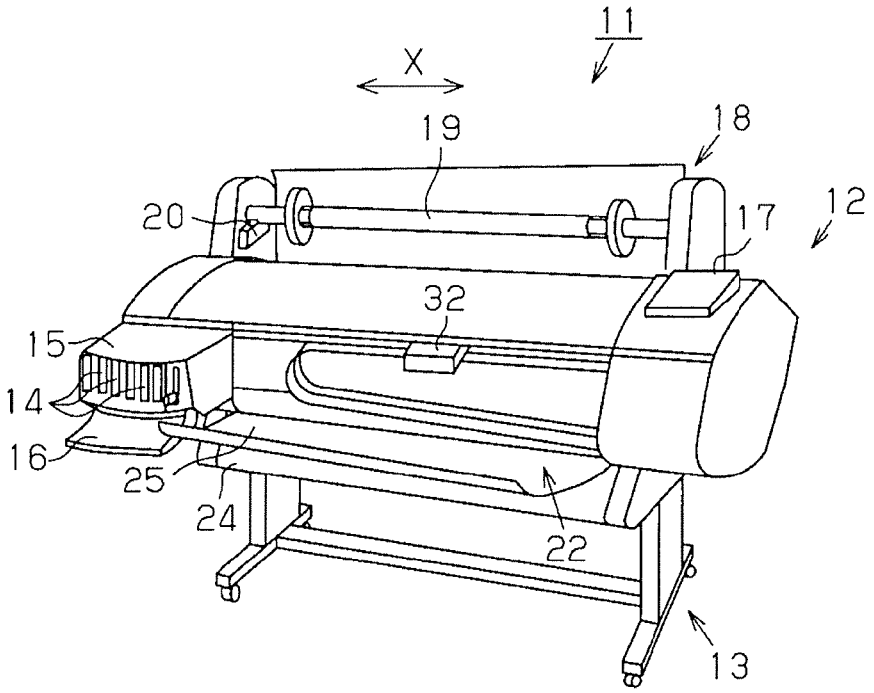

FIG. 1A is a perspective view showing an example of a configuration of the printing device of the present embodiment, and FIG. 1B is a perspective view showing an example of an internal configuration of major components of the printing device. As shown in FIGS. 1A and B, the printing device 11 is an inkjet printer of serial type for carrying out a printing process on printer paper P of roll form (hereinafter termed "roll paper"), as one example of a printing medium. The printing device 11 is provided with a printing device main unit 12 for carrying out the printing process on the roll paper P, and a supporting leg section 13 that supports the printing device main unit 12 from below in the direction of gravity.

To the left side of the printing device main unit 12 when viewed from the front side thereof, there are provided a holder section 15 that contains a plurality of ink cartridges 14 (six are provided in the present embodiment), and a recloseable holder cover 16 that covers the holder section 15 from the front face thereof. The ink cartridges 14 respectively contain inks (printing matters) of mutually different type (e.g., different colors). To the upper right side of the printing device main unit 12 when viewed from the front side thereof, there is provided an operation panel 17 for operation by a user, the operation panel 17 having a liquid crystal screen and various buttons.

On the upper side of the printing device main unit 12 there is provided a medium containing section 18 containing the roll paper P. The roll paper P contained inside this medium containing section 18 is wound onto a shaft member 19 that extends in the main scanning direction X. To either side in the main scanning direction X inside the medium containing section 18 there are respectively provided shaft support sections 20 that support the shaft member 19 in a rotatable state. Through rotation of the shaft member 19 in a prescribed rotation direction (the direction indicated by an arrow in FIG. 3), the roll paper P is reeled out into the printing device main unit 12 as paper of indefinite length. On the front face side of the medium containing section 18 there is provided a detachable containing section cover 21 that covers the roll paper P which is contained inside the medium containing section 18.

Inside the printing device main unit 12 there are provided an ink-spraying section 22 adapted to spray ink onto the roll paper P in a portion thereof which has been conveyed into the printing device main unit 12 interior, and, as one example of the conveying section, a conveying device 23 (see FIG. 3) for conveying the roll paper P towards the ink-spraying section 22. The printing device main unit 12 is also provided with a paper ejection section 24 for ejecting the portion of the roll paper P on which ink has been deposited by the ink-spraying section 22, namely, the portion in which printing is completed. The printing device main unit 12 also has a recloseable main unit cover 25 for covering the interior of the printing device main unit 12.

The description turns next to the ink-spraying section 22.

Figure 2:
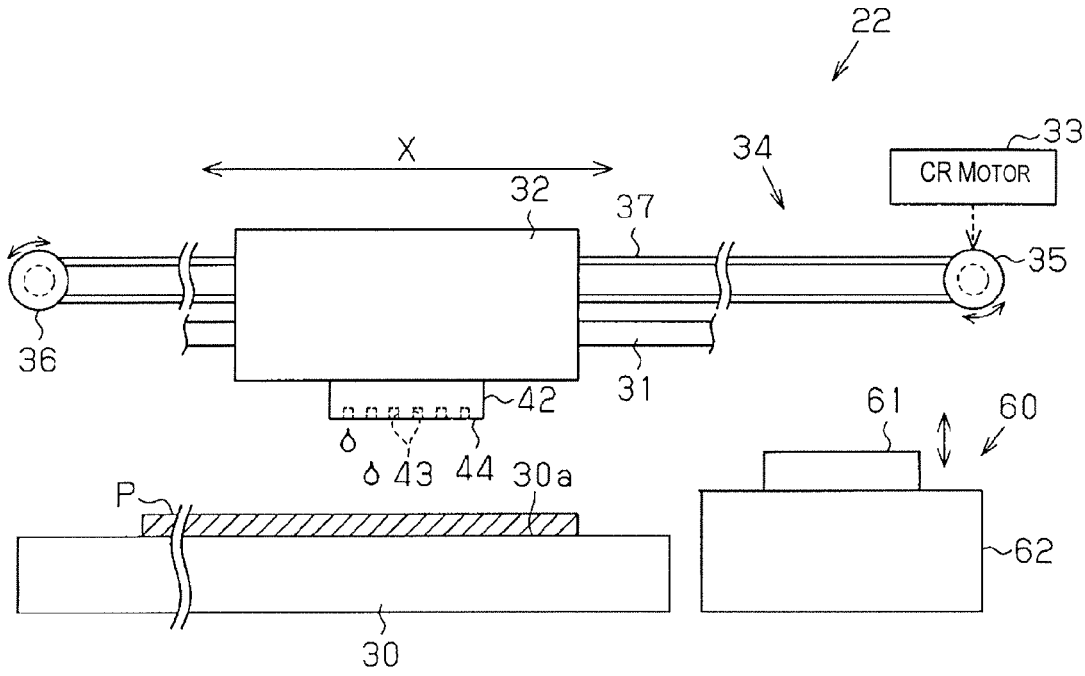
FIG. 2 is a plan view depicting in model form an ink-spraying section of the first embodiment.
Figure 3:
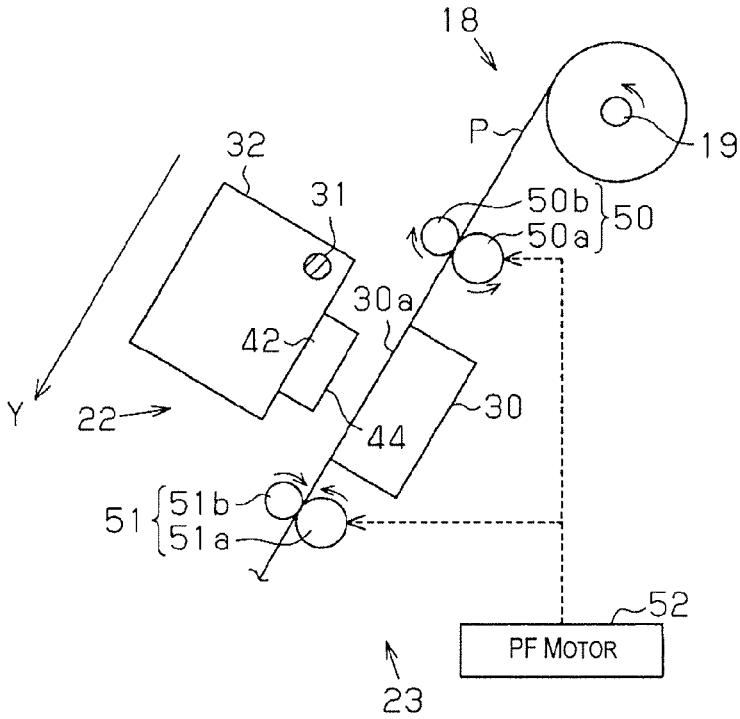
FIG. 3 is a side view depicting in model form an ink-spraying section and a conveying device of the first embodiment.

As shown in FIG. 2 and FIG. 3, the ink-spraying section 22 is provided with a support member 30 which extends in the main scanning direction X (the left-right direction in FIG. 2). This support member 30 is disposed such that the upstream side (the side towards the medium containing section 18) is situated above the downstream side (the side towards the paper ejection section 24) in the sub-scanning direction (conveying direction) Y which is substantially orthogonal to the main scanning direction X. Specifically, the support member 30 has a support face 30*a* that is inclined with respect to the horizontal plane. This support face 30*a* of the support member 30 supports the portion of the roll paper P which has been conveyed into the printing device main unit 12.

The ink-spraying section 22 is provided with a guide shaft 31 that extends in the main scanning direction X, which guide shaft 31 being disposed facing the support face 30*a* of the support member 30. This guide shaft 31 supports a carriage 32, provided as the traveling member, in a state permitting reciprocating travel thereof along the main scanning direction X.

The ink-spraying section 22 is provided with a carriage motor (hereinafter also called the "CR motor") 33 which is rotatable in both the forward and reverse directions, and a carriage drive section 34 which transmits drive power output by the CR motor 33 to the carriage 32. This carriage drive section 34 has a pair of pulleys 35, 36 that are rotatably supported at both edges of the back face of the printing device main unit 12 in the main scanning direction X, and the output shaft (not shown) of the CR motor 33 is linked in power-transmissible fashion to one of the pulleys 35 (the one at the right side in FIG. 2). An endless timing belt 37, a portion of which is linked to the carriage 32, is suspended between the pair of pulleys 35, 36. Through transmission of drive power from the CR motor 33 via the carriage drive section 34, the carriage 32 travels along the main scanning direction X while guided by the guide shaft 31.

Figure 6:
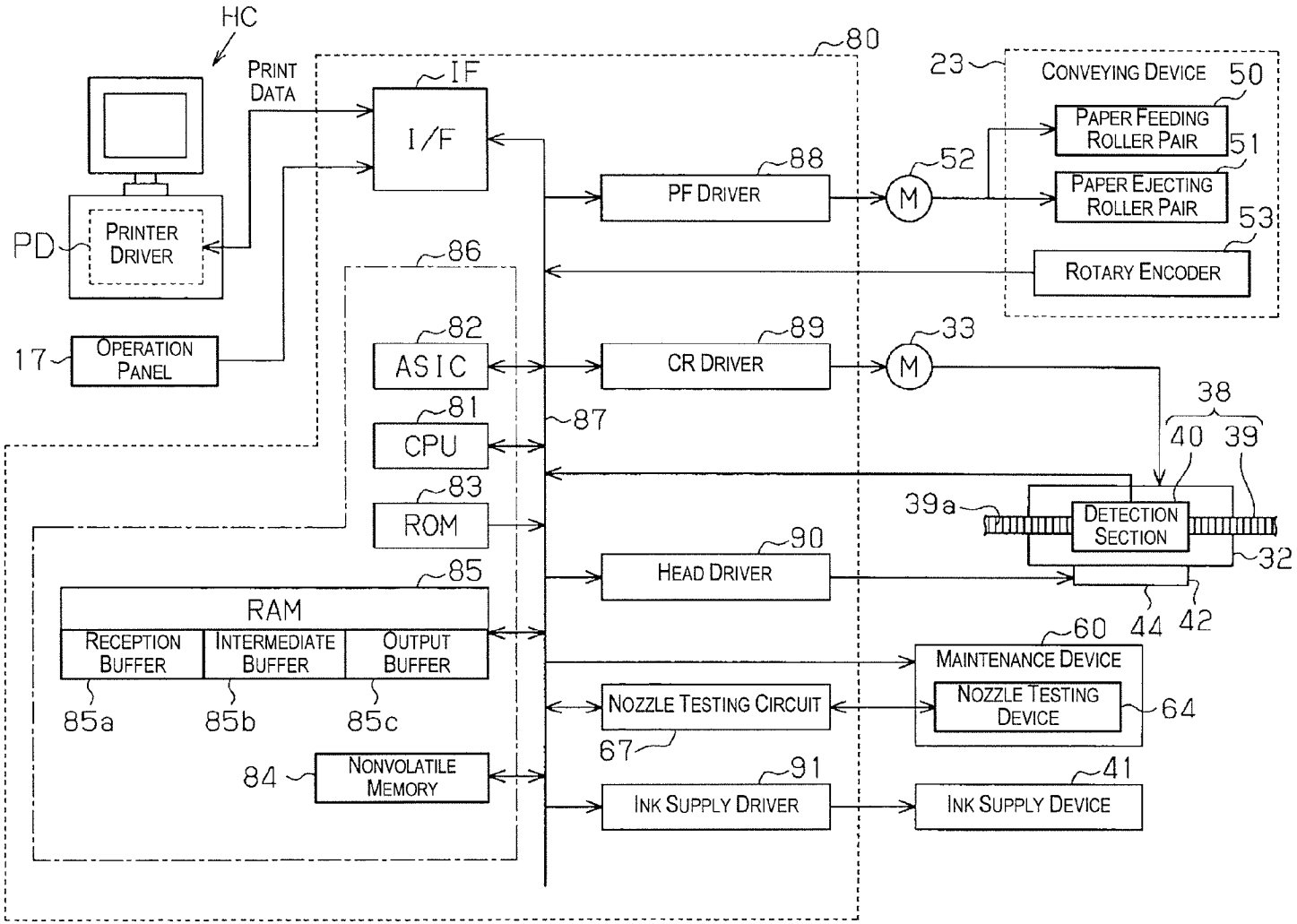
FIG. 6 is a block diagram depicting principal components of the electrical configuration of the printing device of the first embodiment.

To the back face side of the carriage 32 there is provided a linear encoder 38 for the purpose of detecting the position of the carriage 32 in the main scanning direction X, as well as the speed of travel and direction of travel thereof. As shown in FIG. 6, this linear encoder 38 is provided with a tape for detection 39 which extends in the main scanning direction X, and a detection section 40 which is supported on the carriage 32. The tape for detection 39 is supported in an immovable state on the printing device main unit 12, and has a multitude of slits 39*a* formed at equal intervals along the main scanning direction X. The detection section 40 has a plurality of (e.g., two) sensors (not shown) which are disposed at mutually different positions in the main scanning direction X. The sensors of the detection section 40 respectively output pulsed detection signals corresponding to travel distance of the carriage 32 to a control circuit 80 (see FIG. 6).

On the carriage 32, a plurality of sub-tanks (six in the present embodiment; not shown) are provided for temporary individual storage of the different inks which have been supplied from the ink cartridges 14. These sub-tanks are respectively supplied with inks from the individual corresponding ink cartridges 14 through driving by an ink supply device 41 (see FIG. 6).

As shown in FIGS. 2 and 3, a print head 42 is provided to the carriage 32 on the side thereof lying in opposition to the support member 30. This print head 42 is provided with a plurality of nozzles 43 (only six are shown in FIG. 2) supplied with the inks from the sub-tanks, and with a plurality of driving elements (e.g., piezoelectric elements; not shown), which individually correspond to the nozzles 43. The inks supplied from the sub-tanks are sprayed (supplied) from the nozzles 43 towards the support member 30 through driving by the driving elements. Consequently, in the present embodiment, the print head 42 and the carriage 32 constitute the printing section for depositing inks onto a portion of the roll paper P that has been conveyed into the ink-spraying section 22.

Figure 4:
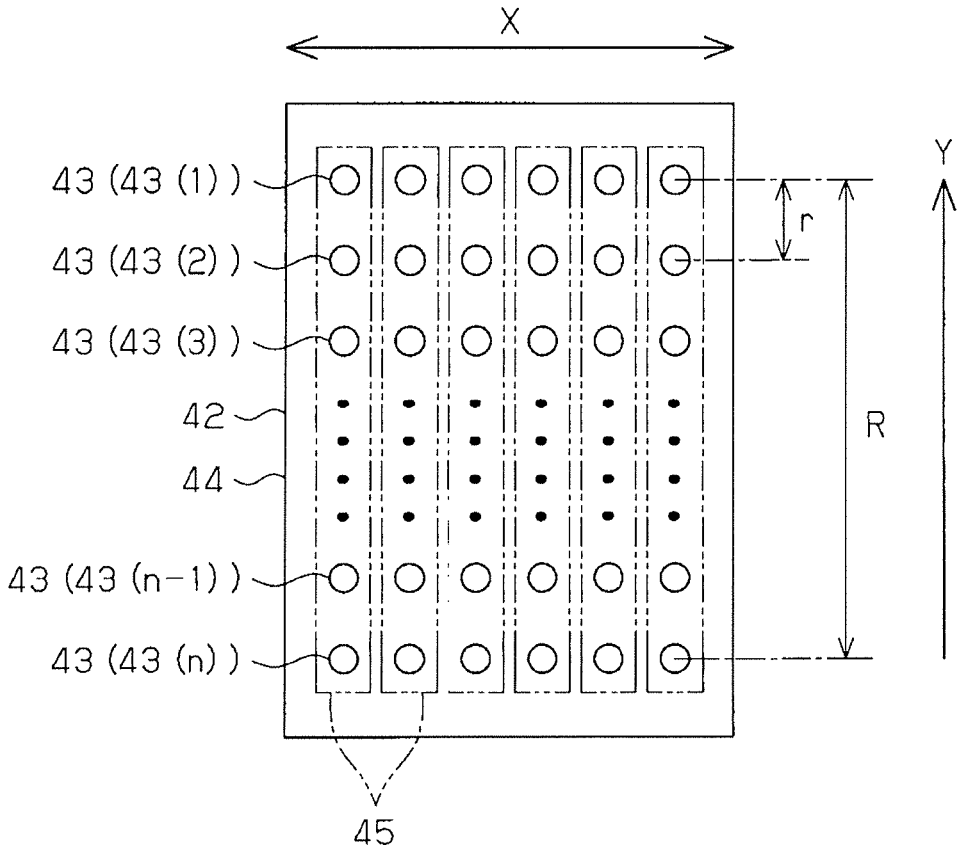
FIG. 4 is a plan view depicting in model form a nozzle-formation face.

As shown in FIG. 4, the opposing face of the print head 42, i.e., the face oriented in opposition to the support member 30, constitutes a nozzle-formation face 44 onto which the nozzles 43 open, and a plurality of nozzle rows 45 (six in the present embodiment; the portions bordered by double-alternatingly-dotted-and-dashed lines in FIG. 4) are formed extending in the sub-scanning direction Y on the nozzle-formation face 44. These nozzle rows 45 individually correspond to the ink cartridges 14, and are disposed at prescribed spacing along the main scanning direction X. The nozzle rows 45 are formed by a number n (e.g., 360) of nozzles 43 which are disposed at a prescribed nozzle pitch r along the sub-scanning direction Y, and the length of the nozzle rows 45 in the sub-scanning direction Y is equal to the head length R. Also, the nozzles 43 that make up the nozzle rows 45 are assigned progressively smaller numbers going towards the downstream side in the sub-scanning direction Y. That is, nozzle 43 (1) is situated further towards the paper ejection section 24 end than is nozzle 43 (3).

Figure 5:
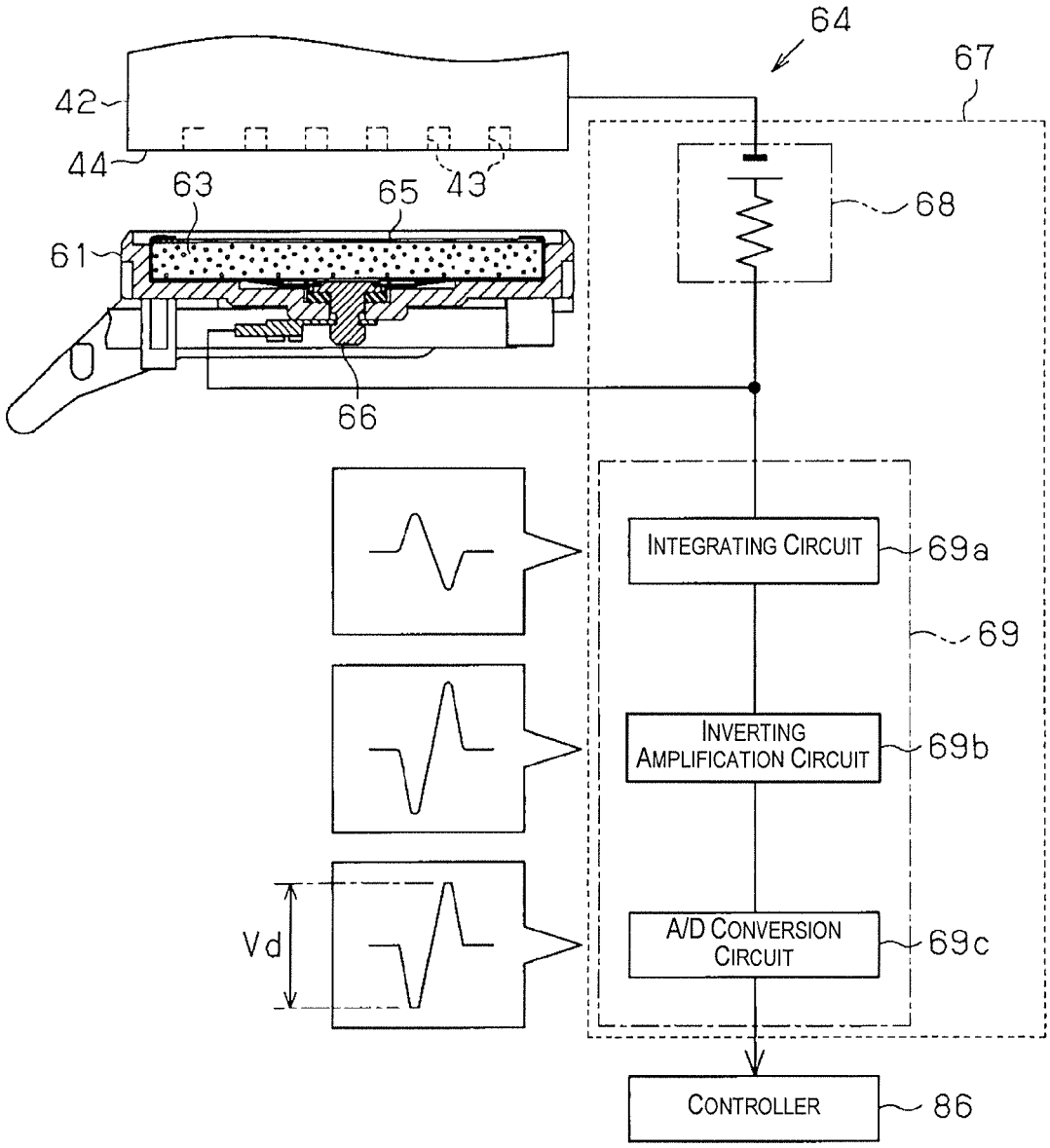
FIG. 5 is a model diagram describing a nozzle testing device.

As shown in FIG. 2, to one side of the support member 30 in the main scanning direction X (the right side in FIG. 2) there is formed a home position to which the roll paper P is not supplied, and a maintenance device 60 for carrying out various kinds of maintenance on the print head 42 is provided at the home position. This maintenance device 60 is provided with a cap (printing matter receiving portion) 61 of bottomed, substantially cylindrical shape adapted to travel in the direction of advancing/retreating from the print head 42 with the latter positioned at the home position (in FIG. 2, the vertical direction, and a direction orthogonal to the support face 30*a*), and with a lifting/lowering mechanism 62 for alternately lifting and lower the cap 61. The maintenance device 60 is also provided with a suction pump (not shown) for discharging ink received into the cap 61 (waste ink) to a waste ink tank, not shown. As shown in FIG. 5, the cap 61 is disposed so as to open towards the side in opposition to the print head 42, and an ink-absorbing material 63 for absorbing sprayed (discharged) ink (also referred to as "waste ink") is contained inside the cap 61.

The maintenance device 60 of the present embodiment is also provided with a nozzle testing device 64 for testing of defective nozzles among the nozzles 43. A defective nozzle indicates a nozzle that cannot spray ink for some reason such as elevated viscosity of the ink inside the nozzle 43, or to one unable to spray ink in an amount in accordance with an instruction from the control circuit 80, discussed later.

The nozzle testing device 64 is provided with a mesh (electrode section) 65 made of metal covering the upper face of the ink-absorbing material 63 (the face on the side in opposition to the print head 42) inside the cap 61, and a plus-side terminal 66 disposed at the center of the bottom part of the cap 61, with the mesh 65 electrically connected to the plus-side terminal 66. A nozzle testing circuit 67 (the portion bordered by broken lines in FIG. 5) is electrically connected to the nozzle testing device 64. This nozzle testing circuit 67 is provided with a voltage application circuit 68 for applying a voltage across the mesh 65 and the nozzle-formation face 44 of the print head 42, and a voltage detection device 69 for detecting change in the voltage value across the mesh 65 and the nozzle-formation face 44. The voltage application circuit 68 is provided with a DC power supply (e.g. 400 V) and a resistor element (e.g. 1 MΩ), so that the mesh 65 serves as the positive pole and the nozzle-formation face 44 serves as the negative pole. Because of this, a positive charge builds up on the mesh 65 on the face thereof in opposition to the print head 43 (in FIG. 5, the upper face), while a negative charge builds up on the nozzle-formation face 44 of the print head 42.

The voltage detection device 69 is provided with an integrating circuit 69*a* for integrating and outputting a detection signal from the mesh 65; an inverting amplification circuit 69*b* for inverting amplification and output of a signal output from the integrating circuit 69*a*; and an A/D conversion circuit 69*c* for performing A/D conversion on signals output from the inverting amplification circuit 69*b*, and outputting the signals to a controller 86.

During nozzle testing by the nozzle testing device 64, ink is sprayed into the cap 61 from a nozzle 43 to be tested. At this time, a negative charge has built up in the ink sprayed from the nozzle 43. As the ink approaches the mesh 65, the positive charge in the mesh 65 gradually increases due to electrostatic induction. As a result, because of induction voltage based on electrostatic induction, the potential difference between the mesh 65 and the nozzle-formation face 44 of the print head 42 is greater than the case where ink is not sprayed from the nozzle 43.

Then, when the ink lands on the mesh 65, part of the positive charge of the mesh 65 is neutralized by the negative charge which has built up in the ink. Thereupon, the potential difference (voltage) between the mesh 65 and the nozzle-formation face 44 of the print head 42 becomes smaller than in the case where ink is not sprayed from the nozzle 43. Subsequently, the potential difference between the mesh 65 and the nozzle-formation face 44 of the print head 42 returns to its initial magnitude. A detection signal related to this potential difference is input to the controller 86 via the integrating circuit 69*a*, the inverting amplification circuit 69*b*, and the A/D conversion circuit 69*c*.

Thereupon, the controller 86 detects the amplitude Vd of the detection signal input to it from the A/D conversion circuit 69*c* (i.e., the amount of change of the voltage value across the mesh 65 and the nozzle-formation face 44 of the print head 42). In a case where the detected amplitude Vd is equal to or greater than a threshold amplitude value, the nozzle 43 being tested is assessed as a normal nozzle, or in a case where the detected amplitude Vd is less than the threshold amplitude value, the nozzle 43 being tested is assessed as a defective nozzle.

The conveying device 23 shall now be described.

As shown in FIG. 3, the conveying device 23 is a device for conveying the roll paper P along the sub-scanning direction Y. This conveying device 23 is provided with a pair of paper-feeding rollers 50 disposed to the upstream side of the support member 30 in the sub-scanning direction Y (shown in FIG. 3 in the diagonal upper right, on the side towards the medium containing section 18), and a pair of paper-ejecting rollers 51 disposed to the downstream side of the support member 30 in the sub-scanning direction Y (shown in FIG. 3 in the diagonal lower left, on the side towards the paper ejection section 24). The paper-feeding roller pair 50 and the paper-ejecting roller pair 51 are respectively composed of drive rollers 50*a*, 51*a* which are caused to rotate by drive power transmitted from a paper feed motor (hereinafter also termed the "PF motor") 52, and follower rollers 50*b*, 51*b* which experience following rotation in association with rotation of the drive rollers 50*a*, 51*a*. Using a rotary encoder 53 disposed in proximity to the output shaft of the PF motor 52, the motor is controlled in terms of rotation speed, amount of rotation, rotation direction, and so on. Through rotation of the drive rollers 50*a*, 51*a* in the direction of the arrows shown in FIG. 3 by drive power transmitted from the PF motor 52, the roll paper P which is nipped between the roller pairs 50, 51 is fed (conveyed) in the sub-scanning direction Y towards the paper ejection section 24.

In the present embodiment, "conveying of the roll paper P" refers to reeling out of the roll paper P as paper of indefinite length, through rotation of the shaft member 19 in a prescribed direction (the direction indicated by an arrow in FIG. 3) inside the medium containing section 18.

The electrical configuration of the printing device 11 shall now be described.

As shown in FIG. 6, a host device HC is connected to the printing device 11 via a communication cable (not shown). Specifically, the control circuit 80 of the printing device 11 is connected to the host device HC via an interface IF, in a state in which sending and receiving of various types of information, such as print data, between them is possible.

Operation information relating to results of operations of the operation panel 17 performed by the user are input to the interface IF of the control circuit 80.

In the host device HC, the CPU (not shown) of the host device HC and a program constitute a printer driver PD which generates print data. The print data includes commands and image data relating to images for printout onto the roll paper P. The printer driver PD converts the resolution of the image data to the print resolution of the printing device 11, and performs a color-conversion process on the converted image data. Then, the printer driver PD performs a halftoning process (tone number conversion process) on the color-converted image data. The printer driver PD then sends the print data including the image data which has undergone the various processes mentioned above to the printing device 11. At this time, depending on the print data extension, the printer driver PD may send the data to the printing device 11 without carrying out some of the above processes.

The printer driver PD divides the print data into a plurality of sequences, and serially sends the divided print data sequences to the printing device 11. Specifically, the printer driver PD sends the printing device 11 data relating to printing parameters first set on the host device HC side. The printing parameters include printing mode (draft printing mode or detail printing mode), the amount of paper fee (amount of conveyance) per instance, the width of the margins on the printing medium, the extension of the print data, the compression format, the description format, and so on.

The printer driver PD then divides the print data into data sequences equivalent to single scan lines of the carriage 32 (hereinafter also referred to as "divided print data sequences"), and serially sends the divided print data sequences to the printing device 11. After the data relating to printing parameters has been sent, the printer driver PD receives, as a response, information relating to a data length Ds (see FIG. 7) from the printing device 11. A more detailed description of the process shall be provided further below. The printer driver PD then generates divided print data sequences of the data length Ds instructed by the printing device 11, and serially sends the divided print data sequences so generated to the printing device 11. The last (final pass) divided print data sequence includes termination information instructing termination of printing.

The control circuit 80 of the printing device 11 shall now be described.

The control circuit 80 is provided with a controller 86 (the portion bounded by the alternatingly-dotted-and-dashed lines in FIG. 4) having a CPU 81, an application-specific IC (ASIC), a ROM 83, a nonvolatile memory 84, and a RAM 85. This controller 86 is electrically connected to the nozzle testing circuit 67 and to various drivers 88, 89, 90, 91 via a bus 87. The controller 86 controls the PF motor 52 via a PF driver 88, and also controls the CR motor 33 via a CR driver 89. The controller 86 controls the print head 42 (specifically, the drive elements inside the print head 42) via a head driver 90, and controls the ink supply device 41 via an ink supply driver 91.

Various control programs and various data are stored in the ROM 83. Various programs such as a firmware program, and various data needed for the printing process, are stored in the nonvolatile memory 84. The RAM 85 temporarily stores program data for execution by the CPU 81; various types of data resulting from operations and resulting from processes by the CPU 81; various types of data processed by the ASIC 82, and the like. The RAM 85 has a reception buffer 85*a*, an intermediate buffer 85*b*, and an output buffer 85*c*. Print data (i.e., divided print data sequences) received from the host device HC is saved to the reception buffer 85*a*, and data currently being processed is saved to the intermediate buffer 85*b*. The processed data is saved to the output buffer 85*c*.

The controller 86 of the present embodiment shall now be described.

Figure 7:
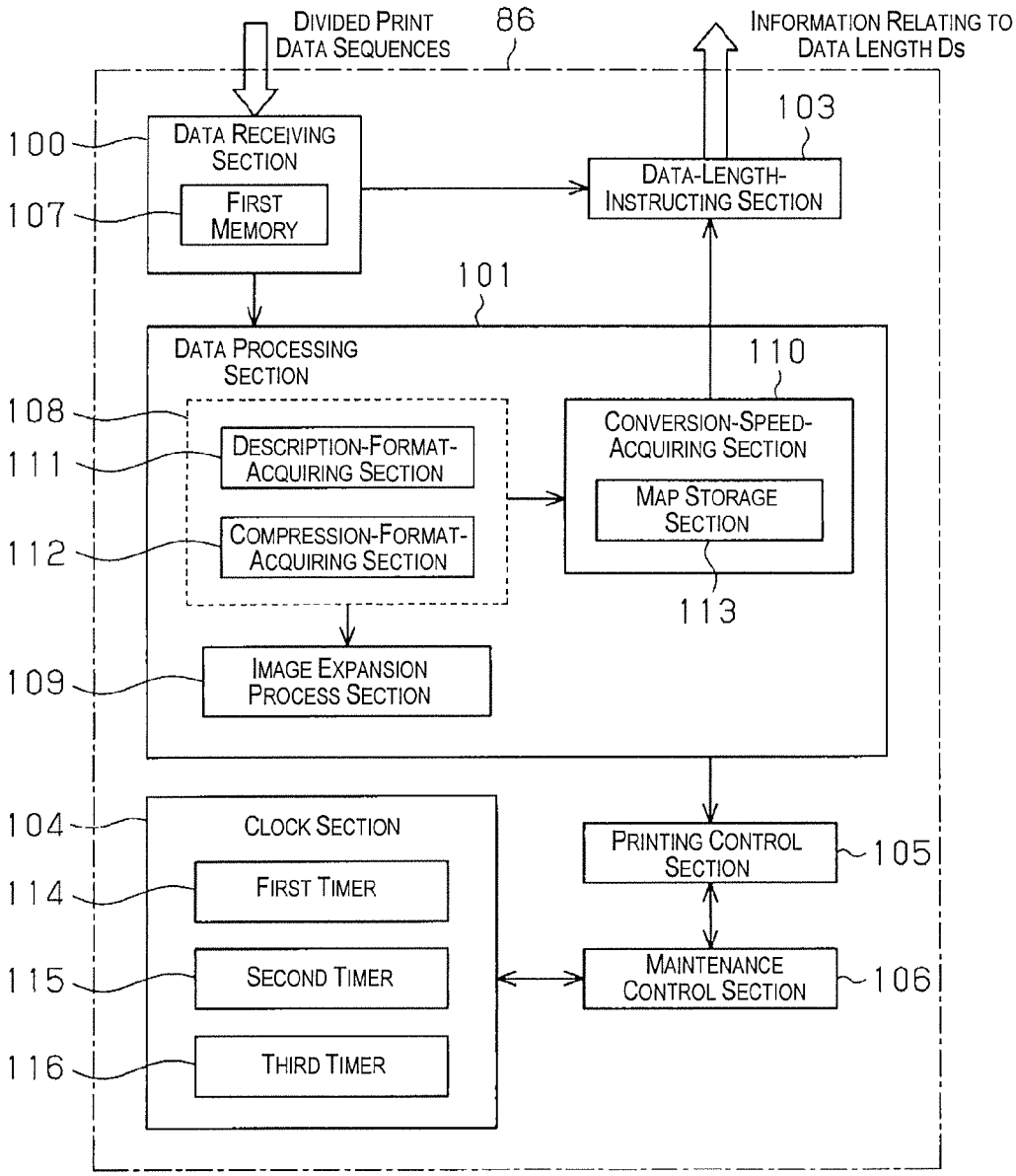
FIG. 7 is a block diagram depicting principal components of the functional configuration of a controller.

As shown in FIG. 7, by way of functional portions realized through hardware and/or software, the controller 86 is provided with a data-receiving section 100, a data processing section 101, a data-length-instructing section 103, a clock section 104, a printing control section 105, and a maintenance control section 106.

The data-receiving section 100 is provided with a first memory 107 for temporarily storing data (data relating to printing parameters, divided print data sequences, and so on) received from the host device HC. The configuration of this first memory 107 includes the reception buffer 85*a*. Consequently, in the present embodiment, the data-receiving section 100 functions as the data-acquiring section.

The data-receiving section 100 outputs data temporarily stored (saved) in the first memory 107 to the data processing section 101. In a case where data sent from the host device HC is being received, the data-receiving section 100 detects the communication speed between the host device HC and the printing device 11. For example, the data-receiving section 100 detects the communication speed (more specifically, the data transmission speed from the host device HC to the printing device 11) on the basis of the data count (bytes) of data that was acquired (received) within a predetermined reference period. The data-receiving section 100 then outputs information relating to the detected communication speed to the data-length-instructing section 103. Consequently, in the present embodiment, the data-receiving section 100 functions as a communication speed-acquiring section as well.

The data processing section 101 is provided with an information-acquiring section 108 (the portion bordered by the broken lines in FIG. 7), an image expansion process section 109, and a conversion-speed-acquiring section 110. In a case where data relating to printing parameters has been input from the data-receiving section 100, the information-acquiring section 108 acquires information of various kinds based on this data. For example, the information-acquiring section 108 has a description-format-acquiring section 111 that, on the basis of data relating to printing parameters, acquires (discriminates) the description format (i.e., the "description language") of the print data, and a compression-format-acquiring section 112 that acquires the compression format on the basis of information relating to the extension of the print data, which is included in the data relating to printing parameters. The information-acquiring section 108 then outputs the acquired information relating to description format and the information relating to compression format to the image expansion process section 109 and to the conversion-speed-acquiring section 110.

From the divided print sequences which were saved to the first memory 107 of the data-receiving section 100, the expansion process section 109 now converts the data (except for commands) to bitmap data in which print dots are represented by tone values, and expands the bitmap data. At this time, there may be instances in which the time needed for expansion of data differs between the case where the compression format of the print data is a first compression format and the case where the compression format is a second compression format, despite the data length Ds being the same length.

Next, on the basis of the expanded data, the expansion process section 109 generates bitmap data (operational data) equivalent to single scans. At this time, there may be instances in which the time needed to generate bitmap data equivalent to a single scan differs between the case where the description format of the print data is a first description format (e.g., RGB) and the case where the description format is a second description format (e.g., CMYK). In a case where an instruction has been input from the printing control section 105, the expansion process section 109 outputs the generated bitmap data equivalent to a single scan to the printing control section 105. Consequently, in the present embodiment, the expansion process section 109 functions as a data conversion section. "Bitmap data equivalent to one scan" refers to the data needed to spray ink onto the roll paper P during travel of the carriage 32 one time in the main scanning direction X, Specifically, during driving of the printing section one time.

On the basis of the information input from the information-acquiring section 108, the conversion-speed-acquiring section 110 acquires the conversion speed of the divided print data sequences within the printing device 11. Namely, the conversion-speed-acquiring section 110 has a map storage section 113 having stored in advance therein a first map that stores expansion speed depending on acquired compression format, and a second map that stores the generation speed depending on acquired description format.

"Expansion speed" refers to a speed that corresponds to a value derived by dividing the data length of a received divided print data sequence by the time needed for the expansion process, and represents the speed at which acquisition is possible through acquisition of the compression format of the received print data. In the present embodiment, an expansion speed associated with the particular compression format of the received divided print data sequence is acquired through the use of a first map that stores a plurality of compression formats and expansion speeds individually corresponding to the compression formats. The conversion-speed-acquiring section 110 then outputs information relating to the acquired (set) expansion speed to the data-length-instructing section 103.

"Generation speed" refers to a speed that corresponds to a value derived by dividing the data length of a generated bitmap data equivalent to a single scan by the time needed from completion of the expansion process to completion of the generation process, and represents the speed at which acquisition is possible through acquisition of the description format of the received print data. In the present embodiment, a generation speed associated with a particular description format of the received divided print data sequence is acquired through the use of a second map that stores a plurality of description formats together with generation speeds individually corresponding to the description formats. The conversion-speed-acquiring section 110 then outputs information relating to the acquired (set) generation speed to the data-length-instructing section 103. Consequently, in the present embodiment, the conversion-speed-acquiring section 110 functions as the speed-acquiring section for acquiring the conversion speed during conversion of print data to operational data by the expansion process section 109.

The data-length-instructing section 103 has a saving section (not shown) to which is saved information relating to communication speed input from the data-receiving section 100, and information relating to expansion speed and information relating to generation speed, which are input from the conversion-speed-acquiring section 110. On the basis of the various types of information saved to the saving section, the data-length-instructing section 103 calculates (sets) a data length Ds of the divided print data sequences sent from the host device HC, and sends information relating to the calculated data length Ds to the host device HC.

The method of setting the data length Ds shall now be described. The time needed for the carriage 32 to travel from a first edge (in FIG. 8, the right edge) to the other edge (in FIG. 8, the left edge) in the sub-scanning direction Y of a printing region on the roll paper P shall be denoted as "mechanical drive time Tm." The time from sending of a divided print data sequence from the host device HC end to completion of the various processes and saving of the data to the output buffer 85*c* shall be denoted as "data processing time Td."

In the present embodiment, data length Ds is calculated such that the data processing time Td is of the same or shorter duration than the mechanical drive time Tm. Specifically, the data processing time Td is calculated on the basis of the relational expression (Expression 1) below. "Maximum data count Dmax necessary for a single nozzle" refers to the data count necessary in a case where ink is sprayed continuously (i.e., so-called solid printing) throughout a single scan of the carriage 32.

"Dmax/A" indicates the time needed for reception of all data for a single nozzle 43, and "Dmax/B" indicates the time needed for expansion of all data for a single nozzle 43. Further, "Dmax/C" indicates the time needed for generation of all data for a single nozzle 43.

$$Td = \left(\frac{Dmax}{A} + \frac{Dmax}{B} + \frac{Dmax}{C}\right) \times N \qquad \text{[Expression 1]}$$

Td: data processing time; Dmax: maximum data count necessary for a single nozzle; A: communication speed; B: expansion speed; C: generation speed; N: number of nozzles constituting a nozzle row The mechanical drive time Tm can be calculated unambiguously, provided that the travel speed of the carriage 32 and the width Hx in the main scanning direction X of the printing region in which ink is deposited onto the roll paper P based on the current print data (see FIG. 8) have been successfully acquired. Assuming that the data processing time Td and the mechanical drive time Tm are the same, the number of nozzles set as candidate nozzles (herein, also referred to as "number of candidate nozzles") KN from among the nozzles 43 that make up the nozzle rows 45 is calculated on the basis of the relational expression (Expression 2) below. If digits are present after the decimal point in the result of the operation of the relational expression (Expression 2), the number of candidate nozzles KN is rounded.

$$KN = Tm \div \left(\frac{Dmax}{A} + \frac{Dmax}{B} + \frac{Dmax}{C}\right) \div RN \quad \text{[Expression 2]}$$

KN: number of candidate nozzles; Tm: mechanical drive time Tm; Dmax: maximum data count necessary for a single nozzle; A: communication speed; B: expansion speed; C: generation speed; N: number of nozzles constituting a nozzle row; RN: number of nozzle rows (=number of colors)

Figure 8A:
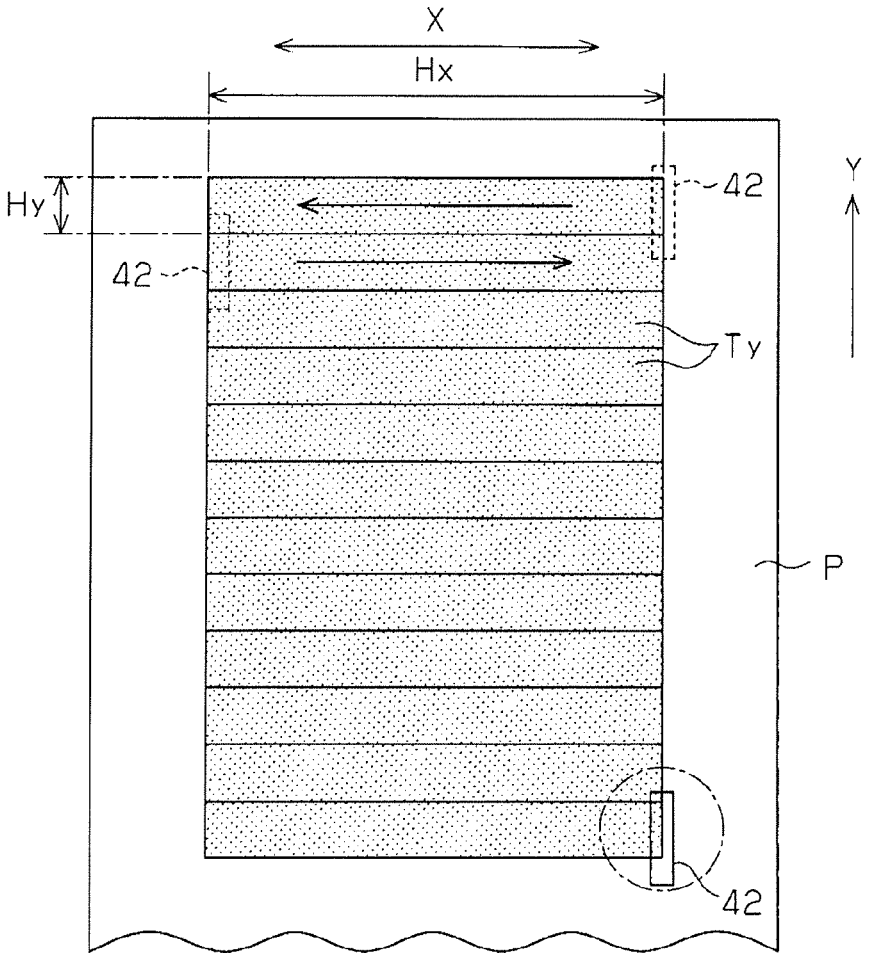
FIG. 8 is an operational diagram A describing the working of a printing process.
FIG. 8B is an enlarged fragmentary view of FIG. 8A.
Figure 8B:
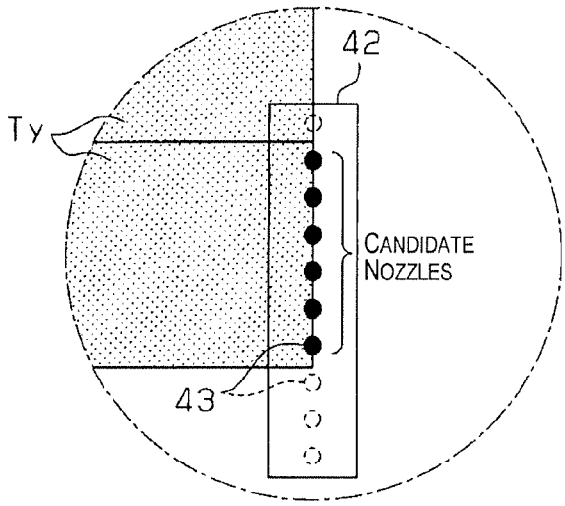

Candidate nozzles are nozzles that may be used during the printing process based on the current print data, whereas nozzles other than the candidate nozzles (also referred to as "unused nozzles") are not used during the printing process based on the current print data. Because of this, as shown in FIGS. 8A and B, a smaller number of candidate nozzles KN calculated with the relational expression (Expression 2) is associated with narrower spacing (width) Hy in the sub-scanning direction Y of regions that are printed in single scans of the carriage 32 (herein also referred to as "single-scan regions") Ty (Hy=numbers of candidate nozzles KN×nozzle pitch r). Specifically, in a case where the communication speed A is slower than a prescribed speed having been set in advance as a reference for communication speed, the spacing Hy is narrower than in a case where the communication speed A is faster than the prescribed speed. Additionally, in a case where the expansion speed B is lower than a prescribed speed having been set in advance as a reference for expansion speed, the spacing Hy is narrower than in a case where the expansion speed B is higher than the prescribed speed. Moreover, in a case where the generation speed C is lower than a prescribed speed having been set in advance as a reference for generation speed, the spacing Hy is narrower than in a case where the generation speed C is higher than the prescribed speed. The data length Ds is calculated on the basis of the relational expression (Expression 3) below. Among the nozzles 43 shown in FIG. 8B, candidate nozzles are indicated by black dots, whereas unused nozzles are indicated by broken line circles.

$$Ds = Dmax \times KN \times RN \quad \text{[Expression 3]}$$

Ds: data length; Dmax: maximum data count necessary for a single nozzle; KN: number of candidate nozzles; RN: number of nozzle rows (alternatively expressed as the number of colors, in the present embodiment, six)

The data-length-instructing section 103 then sends the host device HC information relating to data length Ds calculated on the basis of the relational expressions (Expression 1), (Expression 2), (Expression 3) discussed previously. Thereupon, the host device HC generates divided print data sequences having the data length Ds that was received from the printing device 11, and serially sends the divided print data sequences to the printing device 11.

As shown in FIG. 7, the clock section 104 is provided with a first timer 114, a second timer 115, and a third timer 116. These timers 114 to 116 are respectively composed of clock circuits or the like. The first timer 114 is a timer for timing the interval for performing flushing, which is one of the maintenance processes. The second timer 115 is a timer for timing the interval for performing the aforementioned nozzle testing process, which is one of the maintenance processes. The third timer 116 is a timer for timing the interval for performing cleaning, which is one of the maintenance processes. In the case of an instruction from the maintenance control section 106, discussed later, the clock section 104 outputs to the maintenance control section 106 information relating to time timed by a timer (e.g., the first timer 114), depending on the instruction.

The printing control section 105 outputs to the data processing section 101 an instruction to output data. Then, on the basis of bitmap data equivalent to a single scan input from the data processing section 101, the printing control section 105 controls the CR motor 33, the print head 42 (more specifically, the drive elements housed inside the print head 42), and the PF motor 52, thereby carrying out a printing process on the roll paper P. Consequently, in the present embodiment, the printing control section 105 functions as the printing control section. In a case where generation of bitmap data equivalent to a single scan input for carrying out control of the next spraying of ink is not yet complete in the data processing section 101, the printing control section 105 idles the carriage 32 (and the print head 42) until generation is complete.

In a case where the time timed by the first timer 114 has exceeded a first reference value which was set in advance, the maintenance control section 106 performs the flushing procedure. In a case where the time timed by the second timer 115 has exceeded a second reference value which was set in advance, the maintenance control section 106 performs the nozzle-testing procedure. Further, in a case where the time timed by the third timer 116 has exceeded a third reference value which was set in advance, the maintenance control section 106 performs the cleaning procedure. Specifically, at periodic or non-periodic intervals, the maintenance control section 106 executes maintenance processes for the purpose of maintaining accuracy of printing onto the roll paper P. Consequently, in the present embodiment, the maintenance control section 106 functions as the maintenance control section.

Next, the printing process routine executed by the controller 86 of the present embodiment will be described on the basis of the flowchart shown in FIG. 9 and the timing chart shown in FIG. 10.

The printing process routine is executed at timing coincident with the start of reception of print data from the host device HC. Thereupon, in the first Step S10, the controller 86 carries out a printing start process. Specifically, the controller 86 controls the PF motor 52 to advance the leading edge of the roll paper P into the interior of the ink-spraying section 22.

In the next Step S11, the controller 86 carries out a candidate nozzle number setting process for setting the number of candidate nozzles KN. In a case where the candidate nozzle number setting process is being carried out for the first time in the course of executing the current printing process routine, the controller 86 receives from among the print data the data relating to printing parameters, and through analysis (parsing) of the received data acquires the communication speed A, the expansion speed B, and the generation speed C. The controller 86 then calculates the data length Ds by substituting the acquired speeds A, B, C into the relational expressions (Expression 1) to (Expression 3) shown previously, and sends information relating to the calculated data length Ds to the host device HC end.

Figure 9:
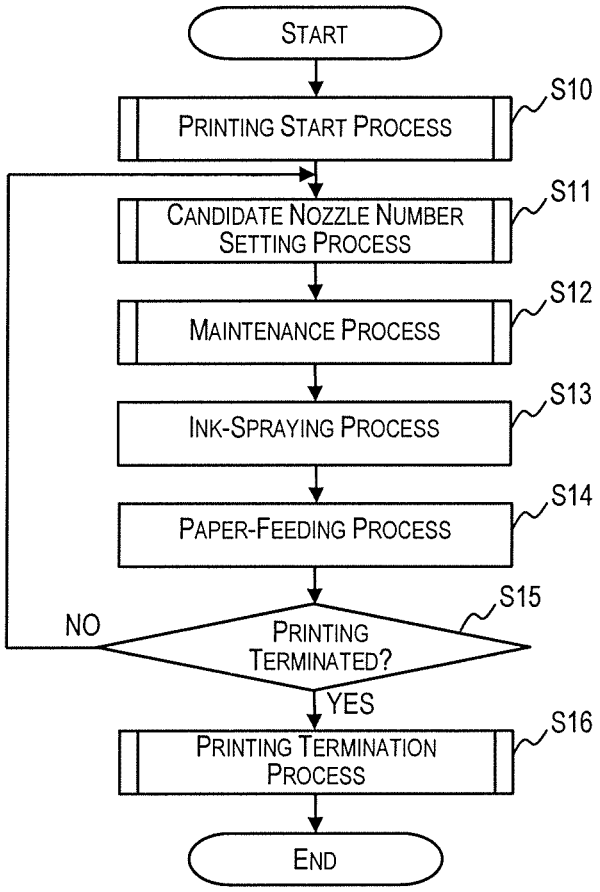
FIG. 9 is a flowchart describing a printing process routine of the first embodiment.
Figure 10:
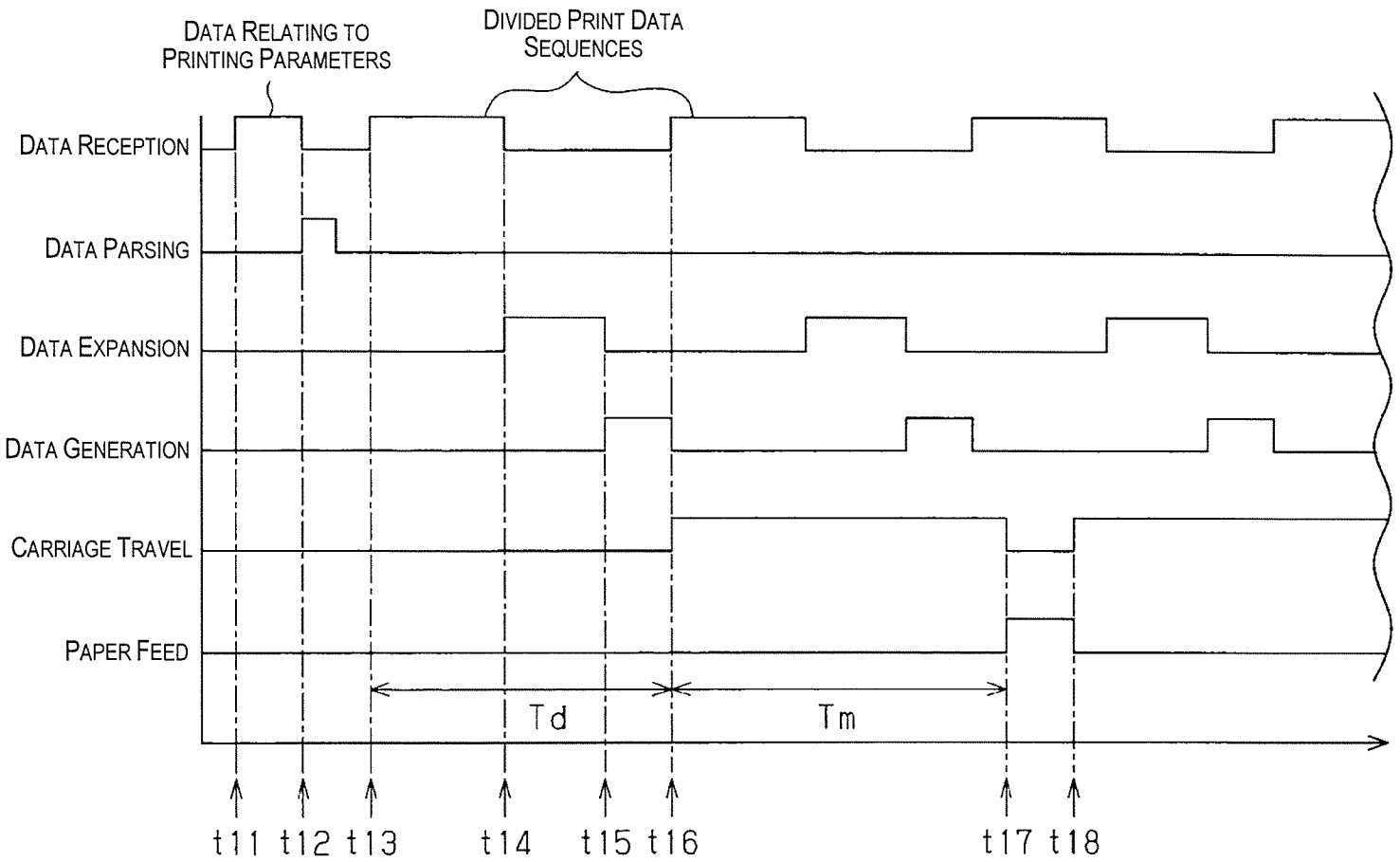
FIG. 10 is a timing chart describing timing of data conversion and the printing process during a printing process.

Here, as shown by the timing chart of FIG. 9, once reception of data relating to printing parameters from among the print data starts in the data-receiving section 100, the communication speed A between the host device HC and the printing device 11 during reception of this data is acquired by the data-receiving section 100 (first timing t11). Once reception of data relating to printing parameters from among the print data is complete (second timing t12), the data relating to printing parameters from among the received print data is parsed, and the compression format and description format of the current print data are acquired by the information-acquiring section 108. Also, on the basis of the acquired compression format and description format, the expansion speed B and the generation speed C are acquired by the conversion-speed-acquiring section 110. The data length Ds is then calculated by the data-length-instructing section 103, and information relating to the data length Ds is sent to the host device HC. Thereupon, reception of divided print data sequences having the set data length starts (third timing t13).

Returning to the flowchart of FIG. 8, in a case where a second or subsequent candidate nozzle number setting process is carried out, the controller 86 analyzes the data for carrying out actual printing, Specifically, the divided print data sequences, and calculates a data length Ds. At this time, there is a possibility of the communication speed A, the expansion speed B, and the generation speed C fluctuating in the current printing process. In particular, with regard to the communication speed A, there is a possibility of fluctuations due to sudden change in the control load on the host device HC end, or the like. Because of this, if at least one speed among the communication speed A, the expansion speed B, and the generation speed C changes in the course of printing, the controller 86 resets the data length Ds, and sends information relating to the reset data length Ds to the host device HC end. At this time, in a case that at least one of the aforementioned speeds (e.g., the communication speed A) has slowed, the controller 86 resets the data length Ds, whereas in a case that at least one of the aforementioned speeds has accelerated, the data length Ds is not reset. Specifically, in the present embodiment, the data length Ds of the divided print data sequences received by the printing device 11 will never become longer in the course of printing, despite sometimes becoming shorter in the course of printing. Consequently, in the present embodiment, Step S11 corresponds to the speed-acquiring step.

In the next Step S12, the controller 86 carries out a maintenance process for the purpose of maintaining accuracy of printing onto the roll paper P. Specifically, in a case where a maintenance process is being carried out for the first time in the course of executing the current printing process routine, the controller 86 acquires the times that are timed by the timers 114 to 116. The controller 86 then carries out a flushing process, nozzle testing process, and cleaning process, as needed.

Or, in a case where a maintenance process is being carried out for a second or subsequent time, the controller 86 acquires the time that is timed by the first timer 114, and carries out a flushing process as needed. Specifically, even though the nozzle testing process and the cleaning process are sometimes executed immediately prior to the start of spraying of ink onto the roll paper P, the processes are never executed after spraying of ink onto the roll paper P has started. In the present embodiment, in a case where a flushing process or nozzle testing process is carried out, the controller 86 carries out the flushing process or nozzle testing process on the candidate nozzles that were set in the process of Step S11, but does not carry out the flushing process or nozzle testing process on the unused nozzles.

Next, the controller 86 carries out an ink-spraying process (Step S13), and carries out a paper-feeding process (Step S14). Consequently, in the present embodiment, Steps S13 and S14 constitute a printing step.

In the ink-spraying process, on the basis of bitmap data equivalent to single scans generated by the data processing section 101, the printing control section 105 controls travel of the carriage 32, as well as controlling spraying of ink from the candidate nozzles among the nozzles 43 of the print head 42. The ink-spraying process may be executed such that driving of the CR motor 33 is started before driving of the PF motor 52 stops, so that spraying of ink from the print head 42 may be carried out simultaneously or immediately after the paper-feeding process has terminated.

In the paper-feeding process, the printing control section 105 controls the PF motor 52 on the basis of the amount of paper feed that was set at the printer driver PD end. In this paper-feeding process, in a case where the printing format is the bidirectional printing format, the paper-feeding roller pair 50 and the paper-ejecting roller pair 51 are driven immediately after spraying of ink from the print head 42 has terminated (or immediately after travel of the carriage 32 has temporarily stopped). Or, in a case where the printing format is the unidirectional printing format, the paper-feeding process involves driving the paper-feeding roller pair 50 and the paper-ejecting roller pair 51 after the ink-spraying process has completed, and while the carriage 32 is traveling to one side in the main scanning direction X.

As shown in FIG. 8A "bidirectional printing" is a printing format in which ink is sprayed from the print head 42 during travel of the carriage 32 in the forward direction (leftward in FIG. 8A), and ink is also sprayed from the print head 42 during travel of the carriage 32 in the reverse direction (rightward in FIG. 8A). "Unidirectional printing" is a printing format in which ink is sprayed from the print head 42 only during travel of the carriage 32 in the forward direction.

In the next Step S15, the controller 86 assesses whether the current printing process has terminated. Specifically, the controller 86 assesses whether the ink-spraying process based on a divided print data sequence that includes termination information has been completed. If the current printing process has not terminated (Step S15: NO), the process is advanced to Step S11 discussed previously in order to continue the printing process, whereas if the current printing process has terminated (Step S15: YES), the process is advanced to the next Step S16.

In Step S16, the controller 86 carries out a printing termination process. Namely, the controller 86 controls the PF motor 52 in order to eject the portion of the roll paper P on which ink has been deposited, Specifically, the portion on which an image has been formed, to the paper ejection section 24, as well as controlling the CR motor 33 so that the print head 42 travels to the home position. With the aim of protecting the print head 42 situated at the home position, the controller 86 positions the cap 61 close to the print head 42, capping the print head 42. The controller 86 then terminates the printing process routine.

Here, as shown by the timing chart of FIG. 9, once reception of a divided print data sequence has completed, the received divided print data sequence is expanded by the image expansion process section 109 (fourth timing t14). Then, once expansion of the divided print data sequence is completed, generation of bitmap data equivalent to a single scan by the image expansion process section 109 starts (fifth timing t15). At this time, the image expansion process section 109 generates the bitmap data equivalent to a single scan in such a way that data based on the received divided print data sequences is assigned to the candidate nozzles, and dummy data (null data) is assigned to the unused nozzles.

Then, once generation of bitmap data equivalent to a single scan by the image expansion process section 109 is completed, reception of the next divided print data sequence by the data-receiving section 100 begins (sixth timing t16). Reception, expansion, and generation of data are executed repeatedly in this manner. The interval from the third timing t13 to the sixth timing t16 corresponds to the data processing time Td.

At the sixth timing t16, travel of the carriage 32 in order to spray ink onto the roll paper P starts, and ink is sprayed at appropriate timing from the print head 42. Subsequently, once travel of the carriage 32, i.e., the ink-spraying process, is completed, the paper-feeding process starts (seventh timing t17). Then, once the paper-feeding process is completed, because generation of the next set of bitmap data equivalent to a single scan has been completed, travel of the carriage 32 and spraying of ink from the print head 42 starts without delay (eighth timing t18). In this way, the ink-spraying process and the paper-feeding process are carried out repeatedly.

According to the embodiment described above, effects such as the following can be obtained.

(1) The spacing Hy in the sub-scanning direction Y of the single-scan regions Ty in which ink is deposited onto the roll paper P by travel of the carriage 32 one time is progressively narrower in association with a lower expansion speed B during expansion of divided print data sequences received by the printing device 11, and with a lower generation speed C during generation of bitmap data equivalent to a single scan. The expansion speed B and the generation speed C are speeds dependent on the type of compression format and description format of the print data for which the printing process is carried out. Therefore, in the present embodiment, because the spacing Hy of the single-scan regions Ty is set on the basis of the expansion speed B and the generation speed C, the spacing Hy of the single-scan regions Ty can be set more accurately than in the case where the spacing Hy of the single-scan regions Ty is set without consideration of the expansion speed B and the generation speed C. Consequently, the size of single-scan regions Ty can be set appropriately.

(2) The data length Ds of the divided print data sequences is set in accordance with the expansion speed B and the generation speed C, such that the data processing time Td is equal to or less than the mechanical drive time Tm. Because of this, idling time of the carriage 32 in the interval between the previous ink-spraying process and the current ink-spraying process can be made shorter than in the case where the data length Ds of the divided print data sequences is set such that bitmap data can be assigned to all of the nozzles 43 constituting the nozzle rows 45, without consideration of the expansion speed B and the generation speed C. Consequently, it is possible to reduce the likelihood of a user misidentifying operation of the printing device 11 as being abnormal.

(3) In a case where the single-scan region Ty formed by the current ink-spraying process (herein also referred to as the "current region") is formed subsequent to drying of the ink deposited in the previous single-scan region Ty that was formed by the previous ink-spraying process (herein also referred to as the "previous region"), the following problem may occur: ink will be sprayed onto a portion adjacent to the previous region in the current ink-spraying process. There is a possibility of some of the ink being deposited on the previous region at this time. Thus, if new ink is deposited on ink that has already dried, there is a risk of diminished image quality in the boundary portion of the previous region and the current region. In this regard, in the present embodiment, because idling time of the carriage 32 is short, there is a greater likelihood that the current region will be formed before the ink deposited in the previous region has dried. Because of this, diminished image quality of images printed onto the roll paper P can be minimized.

(4) In cases where the expansion speed B and the generation speed C are low, the spacing Hy of the single-scan regions Ty is narrower, and the number of times that the carriage 32 travels in the printing process increases. In such cases, the idling time of the carriage 32 in the printing process can be shorter than in the case where the carriage 32 is idled until completion of generation of bitmap data having fixed data length irrespective of the expansion speed B and the generation speed C.

(5) Meanwhile, in cases where the expansion speed B and the generation speed C are high, the spacing Hy of the single-scan regions Ty is wider, and the number of times that the carriage 32 travels in the printing process decreases. As a result, the time needed for the printing process can be shorter than in the case where the expansion speed B and the generation speed C are slow.

(6) In cases where the expansion speed B and the generation speed C are low, the number of candidate nozzles KN that may be used during the printing process is smaller than in cases where the expansion speed B and the generation speed C are high. Because of this, the printing process using the candidate nozzles can be carried out rapidly on the basis of bitmap data of short data length Ds. Consequently, idling time of the carriage 32 in the printing process can be shorter than in the case where the carriage 32 is idled until generation of bitmap data equivalent to single scans on the basis of divided print data sequences having fixed data length irrespective of the expansion speed B and the generation speed C.

(7) The spacing Hy of the single-scan regions Ty is set on the basis of the compression format and description format of the print data. The compression format and description format can be decided through parsing of data relating to printing parameters initially received by the printing device 11. Because of this, the expansion speed B and the generation speed C can be acquired prior to starting the ink-spraying process. Therefore, the spacing Hy of the single-scan regions Ty can be set appropriately from the time of initial travel of the carriage 32.

(8) It is possible for the communication speed A, the expansion speed B, and the generation speed C to fluctuate in the printing process. In particular, there is a risk of sharp fluctuations of the communication speed A, caused by increase in the control load on the host device HC end or the like. Accordingly, in the present embodiment, in cases where at least one speed among the communication speed A, the expansion speed B, and the generation speed C has decreased, the number of candidate nozzles KN and the data length Ds are reset to smaller values in conformity with fluctuation of the speed in question. As a result, even if at least one speed among the communication speed A, the expansion speed B, and the generation speed C has decreased, longer idling time of the carriage 32 in the printing process can be suppressed.

(9) On the other hand, in cases where at least one speed among the communication speed A, the expansion speed B, and the generation speed C has increased, through calculations using the relational expressions (Expression 1) to (Expression 3) discussed above, the number of candidate nozzles KN and the data length Ds are reset to larger values. In this case, because ink spraying has not yet been carried out up to this point with the newly set candidate nozzles, it is necessary to carry out a cleaning process or flushing process so that ink spraying can be carried out appropriately. Thus, there is a risk of printing speed being markedly reduced due to the cleaning process or flushing process being carried out in the course of the printing process. In this regard, in the present embodiment, the number of candidate nozzles KN and the data length Ds are not reset in cases where at least one speed among the communication speed A, the expansion speed B, and the generation speed C has accelerated. Because of this, carrying out a cleaning process or flushing process in the printing process can be avoided, and a reduction of printing speed can be avoided.

(10) In the present embodiment, in a flushing process carried out in the printing process, ink is not discharged from unused nozzles other than the candidate nozzles. Because of this, the amount of ink consumption associated with the flushing process can be made less than in the case where the flushing process is carried out while discharging ink from unused nozzles as well.

(11) The nozzle testing process which is executed at the start of the printing process does not test unused nozzles which will not be used in the current printing process. Because of this, the time needed for the nozzle testing process can be made shorter, and the amount of ink consumption in the nozzle testing process made lower than in the case where testing of unused nozzles is carried out as well.

(12) In recent years, there has been a trend for images printed onto roll paper P to have higher resolutions, which has tended to cause the volume of data in print data to increase. Because of this, longer times are needed for reception, expansion, and generation of data, and there has been a trend for idling times of the carriage 32 to be longer during printing processes. In this regard, in the present embodiment, the data length Ds is set to one that can be processed during the interval of a single scan of the carriage 32 in the ink-spraying process, and reception, expansion, and generation of data is carried out in the units of the data length Ds in question. Because of this, extended idling times of the carriage 32 in print processes can be suppressed. Also, despite increasingly higher image resolutions, increases in the time needed for the printing process can be suppressed.

(Second Embodiment)

Figure 11:
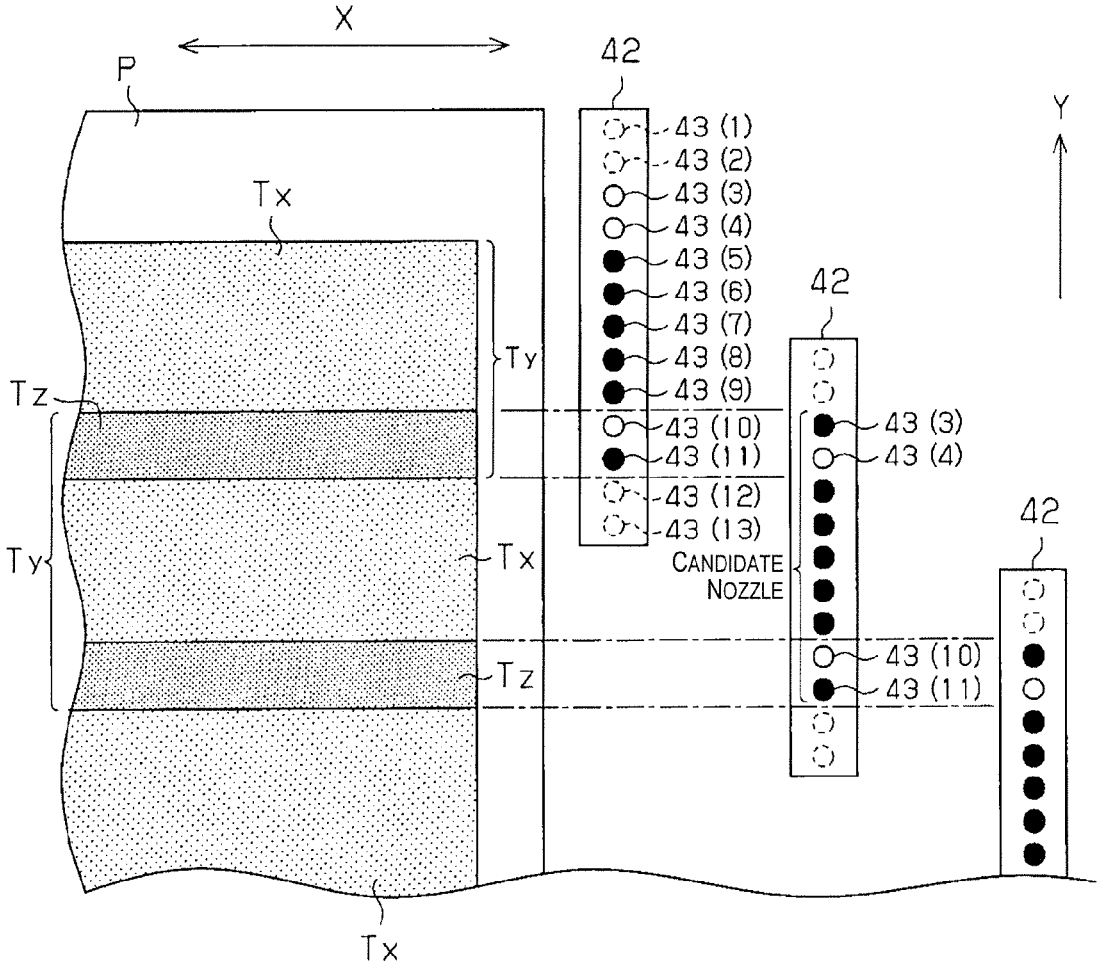
FIG. 11 is an operational diagram describing the working of a printing process in a second embodiment.

Next, a second embodiment of the invention is described on the basis of FIG. 11. The second embodiment differs from the first embodiment in terms of part of the printing method. Consequently, in the following description, the description will focus on portions different from the first embodiment, and the configurations of members identical to or corresponding with those in the first embodiment will be assigned like symbols, with any redundant description being omitted.

In the present embodiment, a printing process of a microwave printing format is carried out. As shown in FIG. 11, this microwave printing format refers to a format in which part of a single-scan region Ty formed by a previous ink-spraying process (the upstream edge in the sub-scanning direction Y (the lower edge in FIG. 11)) and part of a single-scan region Ty being formed by the current ink-spraying process (the downstream edge in the sub-scanning direction Y (the upper edge in FIG. 11)) overlap. In FIG. 11, it is assumed that the number of nozzles 43 constituting one nozzle row 45 is 13; that among nozzles 43(1) to 43(13), nozzles 43(3) to 43(11) are candidate nozzles; and that nozzles 43(1), 43(2), 43(12), and 43(13) are unused nozzles other than the candidate nozzles.

In the case where a printing process is carried out in the microwave printing format, there may be contemplated a first case in which the controller 86 receives divided print data sequences compliant with the microwave printing format, and a second case in which the controller 86 receives divided print data sequences not compliant with the microwave printing format. In the first case, the image expansion process section 109 of the controller 86 converts the received divided print data sequences to bitmap data and expands the data. The image expansion process section 109 then generates bitmap data equivalent to single scans, in such a way that data in accordance with the expanded bitmap data is assigned to the candidate nozzles 43(3) to 43(11), while dummy data is assigned to the unused nozzles 43(1), 43(2), 43(12), and 43(13). Subsequently, the printing control section 105 performs ink-spraying processes and paper-feeding processes based on the bitmap data equivalent to single scans so generated.

Meanwhile, in the second case, the image expansion process section 109 of the controller 86 converts the received divided print data sequences to bitmap data and expands the data. The image expansion process section 109 then generates bitmap data equivalent to single scans, in such a way that data is assigned to the nozzles 43(1) to 43(13) by the following method.

Namely, of the candidate nozzles 43(3) to 43(11), the image expansion process section 109 assigns data in accordance with the expanded bitmap data to the candidate nozzles 43(5) to 43(9) that correspond to the second region Tx. Of the candidate nozzles 43(3), 43(4), 43(10), 43(11) corresponding to the first region Tz, the image expansion process section 109 assigns the expanded bitmap data to candidate nozzles set apart at prescribed intervals in the sub-scanning direction Y. In FIG. 11, of the candidate nozzles 43(3), 43(4), 43(10), 43(11), the image expansion process section 109 has assigned data in accordance with the expanded bitmap data to the candidate nozzles 43(3) and 43(11), while assigning dummy data to the candidate nozzles 43(4) and 43(10). The image expansion process section 109 has also assigned dummy data to the unused nozzles 43(1), 43(2), 43(12), and 43(13).

The printing control section 105 then performs ink-spraying processes and paper-feeding processes on the basis of the bitmap data equivalent to single scans generated in this way.

Consequently, in addition to effects comparable to those of the first embodiment described previously, the present embodiment further affords the effects below.

(13) In the printing process of the present embodiment, part of a single-scan region Ty formed by a previous ink-spraying process and part of a single-scan region Ty being formed by the current ink-spraying process overlap. Because of this, from a standpoint of improving image quality, it is preferable for the current ink-spraying process to be carried out before the ink deposited on the roll paper P by the previous ink-spraying process has dried. In this regard, in the present embodiment, because the data length Ds is set on the basis of the communication speed A, the expansion speed B, and the generation speed C, the idling time of the carriage 32 in the printing process can be shorter. As a result, the time difference from termination of the previous ink-spraying process until the current ink-spraying process starts can be smaller. Consequently, there is a higher likelihood that the current ink-spraying process will be carried out before the ink deposited on the roll paper P by the previous ink-spraying process has dried, and hence this can contribute to improving image quality of images printed onto the roll paper P.

The embodiments described previously may be modified as follows, and optionally, these modifications may be combined.

In the embodiments, in cases where the number of candidate nozzles KN is calculated, optionally, of the nozzles 43 that constitute one nozzle row 45, nozzles situated to the downstream side in the sub-scanning direction Y may be set as the candidate nozzles. Or, optionally, of the nozzles 43 that constitute one nozzle row 45, nozzles situated to the upstream side in the sub-scanning direction Y may be set as the candidate nozzles. Or, optionally, of the nozzles 43 that constitute one nozzle row 45, nozzles situated at the center in the sub-scanning direction Y may be set as the candidate nozzles.

In the embodiments, the first decimal place of the number of candidate nozzles KN calculated on the basis of the relational expression (Expression 2) discussed previously may be rounded off. In this case, the number of candidate nozzles KN would be set in units of "10" on the basis of the communication speed A, the expansion speed B, and the generation speed C.

In the embodiments, in cases where a flushing process of the nozzles 43 is carried out in the printing process, ink is discharged only from unused nozzles other than the candidate nozzles, but in the case of flushing processes executed at times when the printing process is not in progress, optionally, ink may be discharged from all of the nozzles 43.

With such a configuration, clogging of the nozzles 43 for a reason such as a rise in viscosity of the ink inside the nozzles 43 may be suppressed.

Similarly, in nozzle testing processes executed at times when the printing process is not in progress, optionally, ink may be discharged from all of the nozzles 43.

In the embodiments, optionally, the number of candidate nozzles KN and the data length Ds may be reset in cases where the communication has accelerated during the printing process. In this case, because the number of candidate nozzles KN will increase to more than that previously, cleaning of the print head 42 may be carried out. Also, a flushing process may be carried out on nozzles 43 that have been newly set as candidate nozzles. With such a configuration, ink spraying defects can be suppressed, and any decline in printing accuracy can be suppressed.

In the embodiments, because the host device HC and the printing device 11 are connected via a communication cable, the likelihood of the communication speed A fluctuating during the printing process is considered low. For this reason, in cases where the data processing time Td and the number of candidate nozzles KN are calculated using the relational expressions (Expression 1), (Expression 2) discussed previously, the communication speed A may be a prescribed value which has been set in advance. However, the prescribed value is preferably a constant based on results for actual communication speed, acquired through experiments or simulations.

In the embodiments, in cases where there is only one description format for the print data printable by the printing device 11, the generation speed C may be a prescribed value which has been set in advance. In this case, the number of candidate nozzles KN is set to a value depending on the expansion speed B. However, the prescribed value is preferably a constant based on results for actual time needed for generating bitmap data equivalent to single scans from expanded bitmap data, acquired through experiments or simulations.

In the embodiments, in cases where there is only one compression format for print data printable by the printing device 11, the expansion speed B may be a prescribed value which has been set in advance. In this case, the number of candidate nozzles KN is set to a value depending on the generation speed C. However, the prescribed value is preferably a constant based on results for actual time needed for expansion of the received divided print data sequences, acquired through experiments or simulations.

In the embodiments, the spacing Hy of the single-scan regions Ty is set to progressively narrower values in association with lower communication speeds A, but may instead be set in stepwise fashion.

Likewise, the spacing Hy of the single-scan regions Ty is set to progressively narrower values in association with slower expansion speeds B, but may instead be set in stepwise fashion.

Likewise, the spacing Hy of the single-scan regions Ty is set to progressively more narrow values in association with slower generation speeds C, but may instead be set in stepwise fashion.

In the embodiments, optionally, the maintenance device 60 may have a configuration lacking the nozzle testing device 64.

In the embodiment, the printing device may be embodied in a printing device in which, during the printing process, the print head 42 travels in a prescribed conveyance direction, relative to a printing medium as the reference.

In the embodiments, the printing device 11 may be a printing device capable of direct acquisition of print data from an external memory (such as a memory card) or from a digital camera, or the like, without going through a host device HC. In this case, print data stored in the external memory is copied to memory inside (RAM 85, etc.) inside the printing device 11, and the printing process is carried out on the basis of the print data saved in the memory. For this reason, the number of candidate nozzles KN may be set without consideration of the communication speed A for receiving the print data.

The printing device 11 may be a multifunction device provided with a scanner section and the like.

In the embodiments, the printing device 11 may be a "line-head" printing device in which the print head does not travel during printing, or a "lateral" printing device having a plurality of print heads 42 disposed in the main scanning direction X. With these sorts of devices as well, it is preferable for the nozzles 43 to be disposed along the conveyance direction of the printing medium.

In the embodiments, the nozzles 45 may be configured to extend in any direction other than a direction orthogonal of the conveyance direction of the printing medium (i.e., the sub-scanning direction Y).

In the embodiments, the printing medium printed by the printing device 11 is not limited to roll paper; other types of paper (e.g., computer paper) are acceptable.

In the embodiments, the printing device 11 may be embodied in an "on-carriage" printer, in which the ink cartridges 14 are detachably installed on the carriage 32.

Whereas the embodiments describe adoption of an inkjet printer as the printing device 11, fluid spraying devices that spray or eject other fluids besides ink may be adopted as well. Adaptation for use in liquid spraying devices of various types furnished with a liquid spraying head or the like for ejecting very small droplets is also possible. In this case, "drop" refers to the state in which a liquid is ejected from the liquid spraying device, and includes granular shape, teardrop shape, or filiform shape having a tail. Herein, liquid refers to any material that can be sprayed from a liquid spraying device. For example, any state when a substance is in the liquid phase is acceptable, including not only liquid bodies of high or low viscosity, sols, gel water, or other fluid bodies such as inorganic solvents, organic solvents, solutions, liquid resins, and liquid metals (molten metals), and liquids containing a single state of matter, but including also materials in which particles of functional materials composed of solids, such as pigments, metal powders, or the like are dissolved, dispersed, or admixed into a medium. Ink, such as described in the preceding embodiments, or liquid crystals, may also be cited as typical examples of liquids. Herein, the term ink is used in a sense inclusive of ordinary water based inks and oil based inks, as well as various types of liquid compositions such as gel inks, hot-melt inks, and the like. Specific examples of liquid spraying devices are liquid spraying devices for spraying liquids that contain materials such as electrode materials or coloring matter in dispersed or dissolved form, used for manufacturing, for example, liquid crystal displays, EL (electroluminescence) displays, surface emitting displays, color filters, and the like. Further, liquid spraying devices for spraying bioorganic compounds for use in biochip manufacture; liquid spraying devices for spraying liquids as specimens for use as a precision pipettes; textile printing devices; microdispensers, and the like are acceptable as well. Further, liquid spraying devices for pinpoint spraying of lubricants into precision instruments such as clocks or cameras; liquid spraying devices adapted to spray solutions of ultraviolet-curing resins or other transparent resins onto substrates for the purpose of forming micro semi-spherical lenses (optical lenses) for use in an optical communication components etc.; or liquid spraying devices adapted to spray acid or alkali etchant solutions for etching circuit boards, etc., may be adopted as well. The invention may be implemented in any one of these types of liquid spraying device. Additionally, powder bodies such as toner are also acceptable as the fluid. As used in the present Specification, the term "fluid" does not include those composed solely of a gas.

In the embodiments, the printing device 11 may be a printing device of another printing format, such as dot impact or laser formats.

In the embodiments, the communication speed A, the expansion speed B, and the generation speed C may be acquired by the printer driver PD. Specifically, the printer driver PD may set the communication speed A unambiguously, provided that the communication format with the printing device 11 can be recognized. Because the printer driver PD can recognize the compression format or description format of the print data, the expansion speed B and the generation speed C of data inside the printing device 11 can be set as well. The printer driver PD may set the number of candidate nozzles KN and the data length Ds on the basis of the aforementioned relational expressions (Expression 1), (Expression 2), (Expression 3), and serially send divided print data sequences of the set data length Ds to the printing device 11.

With such a configuration, divided print data sequences of data length Ds set on the basis of the communication speed A, the expansion speed B, and the generation speed C are sent to the printing device. Then, in the printing device, the spacing of regions onto which printing matter is deposited by driving of the printing section one time is set to a spacing that is dependent on the data length Ds of the received divided print data sequences. Because of this, the accuracy of setting of the spacing of the aforementioned regions can be made better than in the case where the spacing of the aforementioned regions is set without consideration of the expansion speed B and the generation speed C.

Technical concepts which can be appreciated from the embodiments described above and from other embodiments shall now be given.

(I) A printing device characterized by further including a communication speed-acquiring section for acquiring communication speed when print data is to be received from an outside source, wherein in a case where the communication speed acquired by the communication speed-acquiring section has increased in the course of printing, the spacing of regions onto which printing matter is deposited onto the printing medium by driving of the printing section a single time is maintained by the printing control section in the state prior to an increase in the communication speed.

According to the aforedescribed aspect, in a case where the communication speed has increased in the course of printing, it is possible to widen the spacing of regions onto which printing matter is deposited onto the printing medium by driving of the printing section a single time. However, the widening of the spacing will result in an increase in the number of candidate nozzles. In this case, because spraying of ink has not yet been carried out on the nozzles which have been newly set as candidate nozzles, it is necessary to carry out a maintenance process so that spraying of ink can be carried out appropriately. Because the maintenance process would be carried out in the course of printing, there is a risk of printing speed being markedly reduced. In this regard, in the present embodiment, in a case where the communication speed has increased, the spacing of the regions onto which printing matter is deposited onto the printing medium by driving of the printing section one time remains unchanged. Because of this, maintenance process can be prevented from taking place during the printing process, and a decrease in the printing speed can be avoided.

(II) A program executed by a host device which sends print data to a printing device, wherein the program entails executing: a step of prompting a control section of the host device to estimate communication speed on the basis of communication format during sending of print data to the printing device; a step of estimating expansion speed of print data in the printing device, on the basis of the compression format of the print data; a step of estimating, on the basis of the description format of the print data, generation speed during generation of operational data necessary for driving of the printing section a single time in the printing device; a step of setting, on the basis of the communication speed, expansion speed, and generation speed that were estimated in the aforementioned steps, a data length of data to be sent to the printing device in a single communication; and a step of successively sending to the printing device divided print data sequences generated by division of print data into units of the data length that was set in the aforementioned step.

The entire disclosure of Japanese Patent Application No. 2010-148755, filed Jun. 30, 2010, is incorporated by reference herein.

What is claimed is:

1. A printing device comprising:

a printing section that has a print head configured to deposit printing matter onto a printing medium;

a conveying section configured to cause the printing medium to travel in a prescribed conveyance direction in a relative manner, using the print head as a reference;

a data conversion section configured to acquire a print data from a host device that is configured to communicate with the printing device, and create operating data by carrying out an expansion process on the print data in accordance with a compression format of the print data, and by carrying out a description process of the print data in accordance with a description format of the print data;

a speed-acquiring section configured to acquire a creation speed for carrying out the expansion process and the description process; and a data-length-instructing section configured to receive the creation speed from the speed-acquiring section and a communication speed between the printing device and the host device, set a data length of a next print data based on the creation speed and the communication speed, and send the data length to the host device, the next print data being a print data to be received next to the print data from the host device, the data-length-instructing section shortening the data length of the next print data and sending a shortened data lengh of the next print data to the host device in response to the creation speed being lower than a prescribed speed; and a printing control section configured to control the printing section to cause the printing matter to be deposited onto the printing medium on the basis of the operating data and control the conveying section to cause the printing medium to travel, the printing control section reducing the speed at which the printing section deposits printing matter onto the printing medium to a speed lower than in the case where the creation speed is higher than the prescribed speed in accordance with a next operating data created based on the next print data including the shortened data length in response to the creation speed being lower than the prescribed speed.

2. The printing device according to claim 1, wherein the printing section further has a traveling body for supporting the print head, the traveling body adapted to travel in reciprocating fashion in a scanning direction that intersects the conveyance direction; and in the case where the creation speed acquired by the speed-acquiring section is lower than the prescribed speed, the printing control section performs an operation so that the number of iterations of travel made by the traveling body in the printing process associated with print data is greater than in the case where the creation speed is higher than the prescribed speed.

3. The printing device according to claim 1, wherein the print head has a plurality of nozzles for spraying printing matter, each of the nozzles being disposed in the conveyance direction; and in the case where the creation speed acquired by the speed-acquiring section is lower than the prescribed speed, the printing control section performs an operation so that, among the nozzles, the number of candidate nozzles available for use in the printing process is smaller than in the case where the creation speed is higher than the prescribed speed.

4. The printing device according to claim 3, further comprising:

a printing-matter-receiving section that receives printing matter sprayed from the print head, and a maintenance control section that controls the printing section in order to spray the printing matter into the printing-matter-receiving section from the print head, for the purpose of maintaining accuracy of printing onto the printing medium; wherein in the course of printing onto the printing medium, the maintenance control section disposes the printing-matter-receiving section in opposition to the print head and causes the printing matter to be sprayed into the printing-matter-receiving section from the candidate nozzles, while meanwhile controlling the printing section so as to restrict spray of the printing matter into the printing-matter-receiving section from nozzles other than the candidate nozzles.

5. The printing device according to claim 1, wherein the speed-acquiring section acquires creation speed on the basis of the speed at which the data-acquiring section acquires the print data.

6. The printing device according to claim 1, wherein in a case that the creation speed acquired by the speed-acquiring section has increased during printing, the printing control section maintains the speed at which the printing section deposits printing matter onto the printing medium, in the state before the creation speed increases.

7. The printing device according to claim 1, wherein in a case where the creation speed is lower than a prescribed speed, the printing control section reduces the width in the conveyance direction of a region where printing matter is deposited onto the printing medium by a single driving of the printing section to a width smaller than in the case where the creation speed is higher than the prescribed speed, and thereby reduces the speed at which the printing section deposits the printing matter onto the printing medium.

8. The printing device according to claim 1, wherein in a case that the creation speed acquired by the speed-acquiring section has increased during printing, the data-length-instructing section keeps the data length of the print data the same as before the creation speed increases.

* * * * *